US008446094B2

(12) United States Patent
Niigaki et al.

(10) Patent No.: US 8,446,094 B2
(45) Date of Patent: May 21, 2013

(54) PHOTOCATHODE, ELECTRON TUBE, FIELD ASSIST TYPE PHOTOCATHODE, FIELD ASSIST TYPE PHOTOCATHODE ARRAY, AND FIELD ASSIST TYPE ELECTRON TUBE

(75) Inventors: Minoru Niigaki, Hamamatsu (JP); Toru Hirohata, Hamamatsu (JP); Hiroyasu Fujiwara, Hamamatsu (JP); Akira Higuchi, Hamamatsu (JP)

(73) Assignee: Hamamatsu Photonics K.K., Hamamatsu-shi, Shizuoka (JP)

( * ) Notice: Subject to any disclaimer, the term of this patent is extended or adjusted under 35 U.S.C. 154(b) by 0 days.

(21) Appl. No.: 12/712,546

(22) Filed: Feb. 25, 2010

(65) Prior Publication Data

US 2010/0148667 A1 Jun. 17, 2010

Related U.S. Application Data

(62) Division of application No. 11/819,599, filed on Jun. 28, 2007.

(30) Foreign Application Priority Data

Jul. 5, 2006 (JP) ..... P2006-185944
Jul. 5, 2006 (JP) ..... P2006-185946

(51) Int. Cl.
*H01J 40/06* (2006.01)

(52) U.S. Cl.
USPC ..... 313/542; 313/103 R; 313/537

(58) Field of Classification Search
USPC ..... 313/523, 537, 538, 542, 103 R
See application file for complete search history.

(56) References Cited

U.S. PATENT DOCUMENTS

| | | | | |
|---|---|---|---|---|
| 3,948,143 | A | 4/1976 | Olsen | |
| 5,710,435 | A | 1/1998 | Niigaki et al. | |
| 6,236,033 | B1 | 5/2001 | Ebbesen et al. | |
| 6,441,298 | B1 * | 8/2002 | Thio | 136/250 |
| 2002/0011787 | A1 | 1/2002 | Niigaki et al. | |
| 2003/0202795 | A1 * | 10/2003 | Garcia et al. | 398/147 |
| 2004/0094755 | A1 | 5/2004 | Hirohata et al. | |
| 2005/0168144 | A1 | 8/2005 | Hirohata et al. | |
| 2005/0246148 | A1 * | 11/2005 | Levitan et al. | 703/2 |
| 2005/0264148 | A1 | 12/2005 | Maldonado et al. | |

(Continued)

FOREIGN PATENT DOCUMENTS

| | | |
|---|---|---|
| JP | 6-34548 | 2/1994 |
| JP | 7-050149 | 2/1995 |

(Continued)

*Primary Examiner* — Joseph L Williams
(74) *Attorney, Agent, or Firm* — Drinker Biddle & Reath LLP

(57) ABSTRACT

When light is incident to an antenna layer AA6 of a photocathode AA1, light of a specific wavelength included in the incident light couples with surface plasmons in the antenna layer AA6 whereupon near-field light is outputted from a through hole AA14. The intensity of the output near-field light is proportional to and greater than the intensity of the light of the specific wavelength. The output near-field light has a wavelength that can be absorbed in a photoelectric conversion layer AA4. The photoelectric conversion layer AA4 receives the near-field light outputted from the through hole AA14. A region of the photoelectric conversion layer AA4 around the through hole AA14 absorbs the near-field light and generates photoelectrons ($e^-$) in an amount according to the intensity of the near-field light. The photoelectrons ($e^-$) generated in the photoelectric conversion layer AA4 are outputted to the outside.

14 Claims, 28 Drawing Sheets

U.S. PATENT DOCUMENTS

| | | | | |
|---|---|---|---|---|
| 2005/0275934 | A1 | 12/2005 | Ballato et al. | |
| 2006/0008866 | A1 * | 1/2006 | Flick et al. | 435/34 |
| 2006/0038473 | A1 | 2/2006 | Mochizuki et al. | |
| 2007/0096648 | A1 | 5/2007 | Nakajima et al. | |

FOREIGN PATENT DOCUMENTS

| | | |
|---|---|---|
| JP | 9-180633 | 7/1997 |
| JP | 10-509806 | 9/1998 |
| JP | 2000-031462 | 1/2000 |
| JP | 2000-171763 | 6/2000 |
| JP | 2002-076410 | 3/2002 |
| JP | 2003-268592 | 9/2003 |
| JP | 2005-181296 | 7/2005 |
| JP | 2005-307341 | 11/2005 |
| JP | 2005-328020 | 11/2005 |
| JP | 2005-345402 | 12/2005 |
| JP | 2006-059575 | 3/2006 |
| JP | 2007-303927 | 11/2007 |
| WO | WO 2005/098966 | 10/2005 |

* cited by examiner

*Fig.2*

| | IN USE OF Ag | | | | IN USE OF Al | | | |
|---|---|---|---|---|---|---|---|---|
| PHOTON ENERGY(eV) | 1.0 | 1.5 | 2.0 | 2.5 | 1.0 | 1.5 | 2.0 | 2.5 |
| WAVELENGTH $\lambda_0$(nm) | 1240 | 827 | 620 | 496 | 1240 | 827 | 620 | 496 |
| PERIODIC INTERVAL AA-$\Lambda$(nm) | 1234 | 815 | 601 | 466 | 1239 | 824 | 616 | 491 |

*Fig.15*

| | IN USE OF Ag | | | | IN USE OF Al | | | |
|---|---|---|---|---|---|---|---|---|
| PHOTON ENERGY(eV) | 1.0 | 1.5 | 2.0 | 2.5 | 1.0 | 1.5 | 2.0 | 2.5 |
| WAVELENGTH $\lambda_0$(nm) | 1240 | 827 | 620 | 496 | 1240 | 827 | 620 | 496 |
| PERIODIC INTERVAL BB-$\Lambda$(nm) | 1234 | 815 | 601 | 466 | 1239 | 824 | 616 | 491 |

PHOTOCATHODE, ELECTRON TUBE, FIELD ASSIST TYPE PHOTOCATHODE, FIELD ASSIST TYPE PHOTOCATHODE ARRAY, AND FIELD ASSIST TYPE ELECTRON TUBE

This is a divisional application of copending U.S. patent application Ser. No. 11/819,599, filed on Jun. 28, 2007, (now pending) which is incorporated by reference herein in its entirety.

BACKGROUND OF THE INVENTION

1. Field of the Invention

The present invention relates to a photocathode, an electron tube, a field assist type photocathode, a field assist type photocathode array, and a field assist type electron tube.

2. Related Background Art

There is a conventionally known apparatus in which an optical filter is disposed on a light entrance surface of a photocathode, for example as described in Patent Document 1, for the purpose of detecting light of a specific wavelength. In this apparatus, when light is incident to the optical filter, the optical filter filters out light of the wavelengths other than the specific wavelength included in the incident light. The photocathode absorbs the light of the specific wavelength transmitted by the optical filter, to generate photoelectrons ($e^-$).

A known photocathode of an electric-field-assisted type (which is called a field assist type) is one consisting of a stack of a substrate, a photon absorbing layer (light absorbing layer) for generating photoelectrons, and an electron emitting layer for accelerating the photoelectrons generated in the light absorbing layer, for example, as described in Patent Document 1. In the photocathode described in Patent Document 1, contact pads (electrodes) are connected to the photon absorbing layer and to the electron emitting layer, respectively, and a bias voltage is applied between these contact pads. The electrons (photoelectrons) generated in the photon absorbing layer are accelerated by an electric field established in the photocathode according to the application of the bias voltage, and are emitted from the electron emitting layer.

[Patent Document 1] Japanese Patent Application Laid-open No. H6-34548

SUMMARY OF THE INVENTION

Problem to be Solved by the Invention

The photocathode as described above is required to have an excellent light detection sensitivity. In addition, there are increasing demands for a photocathode, for example, permitting easy manufacture and miniaturization of apparatus, while maintaining a good detection sensitivity for light.

An object of the present invention is therefore to provide a photocathode, an electron tube, a field assist type photocathode, a field assist type photocathode array, and a field assist type electron tube exhibiting an excellent light detection sensitivity and good manufacturability.

Means for Solving the Problem

For example, in the apparatus described in Patent Document 1 the light is incident through the optical filter to the photocathode. For this reason, the photocathode can receive the light with attenuated intensity, when compared with the case where the light is directly received without intervention of the optical filter. When the photocathode receives the light with attenuated intensity, it generates a reduced amount of photoelectrons ($e^-$), so as to degrade the detection sensitivity for the light of the specific sensitivity.

Another conceivable technique for detection of the light of the specific wavelength is to make the photocathode of a material that selectively absorbs only the light of the specific wavelength. In this case, however, it is necessary to prepare the material that absorbs only the light of the specific wavelength, in the manufacture of the photocathode. Since it is extremely difficult to obtain such a material, it becomes difficult to manufacture the photocathode.

A photocathode of the present invention and an electron tube using the photocathode, as will be described below, were attained for the purpose of providing the photocathode with an excellent detection sensitivity for the light of the specific wavelength and easy manufacturability, and the electron tube using the photocathode.

Namely, a photocathode according to the present invention is a photocathode comprising: (1) an antenna layer which has a through hole penetrating in a thickness direction and in a surface of which a pattern according to a predetermined rule is formed for inducing surface plasmon resonance; and (2) a photoelectric conversion layer which is joined to the antenna layer and which absorbs light outputted from the through hole, to generate photoelectrons.

The photocathode according to the present invention comprises the antenna layer which induces the surface plasmon resonance. When light (hv) is incident to the pattern-formed surface in this antenna layer, light of a specific wavelength in the incident light (hv) couples with surface plasmons in the antenna layer to induce plasmon resonance. When the plasmon resonance takes place, near-field light is outputted from the through hole of the antenna layer.

It is conventionally known that the wavelength of light to induce the plasmon resonance in the antenna layer is determined by a material and a surface structure of the antenna layer. Therefore, by properly determining the material of the antenna layer and the pattern in the surface of the antenna layer, it becomes feasible to induce the plasmon resonance with the light of the specific wavelength. Furthermore, it is conventionally known that the wavelength of the near-field light outputted from the antenna layer is also determined by the material and the surface structure of the antenna layer. Therefore, by properly determining the material of the antenna layer and the pattern in the surface of the antenna layer, it becomes feasible to output the near-field light of the wavelength that can be absorbed in the well-known photoelectric conversion layer. Hence there is no need for preparing a photoelectric conversion layer made of a special material. This facilitates the manufacture of the photocathode.

The photoelectric conversion layer receives the near-field light outputted from the through hole of the antenna layer, to generate photoelectrons ($e^-$) by the near-field light. The intensity of the near-field light is proportional to and greater than the intensity of the light of the specific wavelength included in the incident light (hv). Consequently, the photoelectric conversion layer generates a sufficient amount of photoelectrons ($e^-$), so that a sufficient amount of photoelectrons ($e^-$) are outputted from the photocathode. Therefore, the photocathode of the present invention is able to detect the light of the specific wavelength at high S/N ratios. It has an excellent detection sensitivity for the light of the specific wavelength accordingly.

In the photocathode according to the present invention, preferably, the photoelectrons generated in the photoelectric conversion layer are outputted from the through hole of the antenna layer to the outside. The photoelectrons ($e^-$) by the near-field light are generated in a region around the through hole in the photoelectric conversion layer. Therefore, when the photoelectrons are arranged to be outputted through the through hole to the outside, the photoelectrons ($e^-$) generated in the region around the through hole, i.e., the photoelectrons ($e^-$) by the near-field light are outputted with certainty. As a result, the photocathode of the present invention comes to have an exceptionally high detection sensitivity for the light of the specific wavelength.

In the photocathode according to the present invention, preferably, the antenna layer has a plurality of projections and a recess located between the projections, the projections and the recess form the pattern, and the through hole is provided in the recess. In this case, the shape of the pattern can be changed by appropriately varying locations of the projections and recess or the like. As a result, it becomes feasible to readily change the wavelength of the light to induce the plasmon resonance in the antenna layer.

In the photocathode according to the present invention, preferably, the predetermined rule in the pattern is determined so that an amount of photoelectrons generated in the photoelectric conversion layer is larger than an amount of photoelectrons generated in a photoelectric conversion layer in a configuration in which an antenna layer having a through hole and having neither of the projections and the recess formed in its surface is joined to the photoelectric conversion layer. In this case, a sufficient amount of photoelectrons are generated in the photoelectric conversion layer, so that the photocathode can be obtained with a much better detection sensitivity for the light of the specific wavelength.

In the photocathode according to the present invention, preferably, the antenna layer has a plurality of through holes and the plurality of through holes form the pattern. In this case, the shape of the pattern can be changed by properly varying locations of the through holes or the like, so that the wavelength of the light to induce the plasmon resonance in the antenna layer can be readily changed.

In the photocathode according to the present invention, preferably, a minimum width of the through hole is shorter than a wavelength of incident light. When the minimum width of the through hole is thus shorter, the near-field light can be surely outputted from the through hole.

In the photocathode according to the present invention, preferably, a portion facing the through hole of the antenna layer in the surface of the photoelectric conversion layer is provided with an active layer for lowering a work function of the portion. In this case, it becomes easy to output the photoelectrons ($e^-$) generated in the photocathode, through the through hole into vacuum.

In the photocathode according to the present invention, preferably, the active layer is comprised of an alkali metal, an oxide of an alkali metal, or a fluoride of an alkali metal. In this case, the aforementioned effect can be suitably achieved.

An electron tube according to the present invention comprises the above-described photocathode. The electron tube using the photocathode is easy to manufacture and able to accurately detect the light of the specific wavelength.

On the other side, for example, the photocathode described in Patent Document 1 emits thermal electrons as well as the photoelectrons. For this reason, they make great noise. It is possible to reduce the noise due to the thermal electrons by cooling the photocathode, but in this case a cooling means is additionally needed, which makes it difficult to construct the photocathode in a compact structure.

Therefore, a field assist type photocathode of the present invention and a field assist type photocathode array or a field assist type electron tube using the field assist type photocathode, which will be described below, were attained for the purpose of providing the field assist type photocathode having an excellent light detection sensitivity and permitting miniaturization, and the field assist type photocathode array or field assist type electron tube using the field assist type photocathode.

Namely, a field assist type photocathode according to the present invention is a field assist type photocathode comprising: (1) a light absorbing layer for absorbing incident light to generate photoelectrons; (2) a first electrode formed on a side of a first principal surface of the light absorbing layer; and (3) a second electrode formed on a side of a second principal surface of the light absorbing layer and, together with the first electrode, used for applying a voltage between the first principal surface and the second principal surface of the light absorbing layer; (a) wherein the first electrode has a through hole penetrating in a thickness direction and a pattern according to a predetermined rule for inducing surface plasmon resonance is formed in a surface of the first electrode; (b) wherein the light absorbing layer absorbs light outputted from the through hole of the first electrode, to generate the photoelectrons, and emits the photoelectrons generated, through the through hole of the first electrode to the outside.

In the field assist type photocathode of the present invention, the first and second electrodes can apply the voltage between the first principal surface and the second principal surface of the light absorbing layer. The pattern for inducing the surface plasmon resonance is formed in the surface of the first electrode. For this reason, when light (hv) is incident to the surface of the first electrode, light of a specific wavelength included in the incident light (hv) couples with surface plasmons in the first electrode to induce plasmon resonance. When the plasmon resonance is induced, near-field light is outputted from the through hole of the first electrode.

The light absorbing layer absorbs the near-field light outputted from the through hole, in a region located around the through hole of the first electrode. Then it generates photoelectrons by the near-field light in that region. The photoelectrons generated in the region around the through hole migrate by virtue of an electric field established by application of the voltage and are emitted through the through hole of the first electrode to the outside. The intensity of the near-field light is proportional to and greater than the intensity of the light of the specific wavelength included in the incident light (hv). Consequently, a sufficient amount of photoelectrons are generated in the light absorbing layer and emitted through the through hole to the outside.

The light absorbing layer generates thermal electrons as well as the photoelectrons, in the region located around the through hole of the first electrode. The thermal electrons generated in the region around the through hole are emitted through the through hole to the outside as the photoelectrons are. An amount of the thermal electrons generated in the region around the through hole is extremely small, as compared with the total amount of thermal electrons generated in the entire light absorbing layer. Therefore, the amount of thermal electrons emitted to the outside is very small.

In the field assist type photocathode according to the present invention, as described above, the amount of photoelectrons emitted is increased while the amount of thermal electrons emitted is decreased; therefore, the noise due to the thermal electrons can be reduced. It is then feasible to improve S/N ratios and to detect the light with an excellent sensitivity. Since the noise due to thermal electrons can be reduced without need for use of any cooling means or the like, it is feasible to achieve miniaturization of the field assist type photocathode.

The field assist type photocathode according to the present invention is preferably configured as follows: it further comprises a support substrate; an electron emitting layer formed on the light absorbing layer and adapted to accelerate the photoelectrons generated in the light absorbing layer; and a contact layer formed on the electron emitting layer; wherein the light absorbing layer is formed on the support substrate; wherein the first electrode is electrically connected to the contact layer; wherein the second electrode is electrically connected to the support substrate. In this case, the field assist type photocathode consisting of the stack of layers can be obtained as a field assist type photocathode having an excellent light detection sensitivity and permitting miniaturization.

The field assist type photocathode according to the present invention is preferably configured as follows: it further comprises a support substrate; and an electron emitting layer formed on the light absorbing layer and adapted to accelerate the photoelectrons generated in the light absorbing layer; wherein the light absorbing layer is formed on the support substrate; wherein the first electrode makes a Schottky junction with the electron emitting layer; wherein the second electrode is electrically connected to the support substrate. In this case, we can obtain the field assist type photocathode of the Schottky junction type having an excellent light detection sensitivity and permitting miniaturization.

In the field assist type photocathode according to the present invention, preferably, the first electrode has a plurality of projections and a recess located between the projections, the projections and the recess form the pattern, and the through hole is provided in the recess. The wavelength of the light to induce the plasmon resonance is determined by a material and a surface structure of the first electrode. Therefore, the wavelength of the light to induce the plasmon resonance can be changed by varying locations of the projections and the recess or the like to appropriately change the pattern in the surface of the first electrode. As a result, it is feasible to readily change the wavelength of the light that can be detected by the field assist type photocathode.

In the field assist type photocathode according to the present invention, preferably, the predetermined rule in the pattern is determined so that an amount of photoelectrons generated in the light absorbing layer is larger than an amount of photoelectrons generated in a light absorbing layer in a configuration in which a photocathode comprises a first electrode having a through hole and having neither of the projections and the recess formed in its surface. In this case, a sufficient amount of photoelectrons can be generated in the light absorbing layer and thus we can obtain the field assist type photocathode far excellent in the light detection sensitivity.

In the field assist type photocathode according to the present invention, preferably, the first electrode has a plurality of through holes and the plurality of through holes form the pattern. The wavelength of the light to induce the plasmon resonance is determined by the material and the surface structure of the first electrode. Therefore, the wavelength of the light to induce the plasmon resonance can be changed by varying locations of the through holes in the first electrode or the like to appropriately change the pattern in the surface of the first electrode. As a result, it is feasible to readily change the wavelength of the light that can be detected by the field assist type photocathode.

In the field assist type photocathode according to the present invention, preferably, a minimum width of the through hole is shorter than a wavelength of light incident to the first electrode. When the minimum width of the through hole is thus shorter, the near-field light can be surely emitted from the through hole. Furthermore, since an amount of thermal electrons generated in the region around the narrow through hole is overwhelmingly smaller than the total amount of thermal electrons generated in the entire light absorbing layer, it is feasible to securely reduce the amount of thermal electrons emitted to the outside.

Preferably, when viewed from a direction normal to the principal surfaces of the light absorbing layer, a portion inside the through hole of the first electrode is provided with an active layer for lowering a work function of the portion. In this case, it becomes easy to output the photoelectrons generated in the photocathode, through the through hole into vacuum.

In the field assist type photocathode according to the present invention, preferably, the active layer is comprised of an alkali metal, an oxide of an alkali metal, or a fluoride of an alkali metal. In this case, the aforementioned effect can be well achieved.

The field assist type photocathode according to the present invention is preferably configured as follows: it further comprises a plurality of first electrodes; at least two out of the plurality of first electrodes have their respective periods of the patterns different from each other. In this case, since the periods of the patterns are different from each other, the wavelengths of light to induce the plasmon resonance are also different from each other. Therefore, we can obtain the field assist type photocathode that can detect light beams of two or more wavelengths.

In the field assist type photocathode according to the present invention, preferably, the plurality of first electrodes are adapted so that each first electrode can individually apply a voltage. For example, when the voltage is applied between one of the plurality of first electrode and the second electrode, light of a certain wavelength can be detected. Next, when the voltage is applied between another first electrode with a pattern different from that of the previous first electrode, instead of the previous first electrode, and the second electrode, light of another wavelength different from the previously detected one can be detected. Namely, while the field assist type photocathode of the present invention is one device, it is able to individually detect light of multiple wavelengths included in the incident light (hv).

A field assist type photocathode array according to the present invention is one comprising a plurality of above-described field assist type photocathodes, wherein the first and second electrodes of the field assist type photocathodes are adapted so as to be able to apply a voltage to each field assist type photocathode. In this case, it becomes feasible to apply the voltage between the first and second electrodes in all the field assist type photocathodes, or to apply the voltage between the first and second electrodes only in some of the field assist type photocathodes. As a result, it becomes feasible to adjust the light detection sensitivity.

A field assist type electron tube according to the present invention is one comprising the above-described field assist type photocathode. The field assist type electron tube using the field assist type photocathode is able to achieve reduction in the noise due to thermal electrons and miniaturization.

An electron tube according to the present invention is one comprising the above-described field assist type photocathode array. The field assist type electron tube using the field assist type photocathode is able to achieve reduction in the noise due to thermal electrons, miniaturization, and adjustment of the light detection sensitivity.

Effect of the Invention

The present invention successfully provides the photocathode, electron tube, field assist type photocathode, field assist type photocathode array, and field assist type electron tube with the excellent light detection sensitivity and good manufacturability.

BRIEF DESCRIPTION OF THE DRAWINGS

FIG. 2 is a table showing a relation between wavelengths of light and periodic intervals of the antenna layer.

FIG. 15 is a table showing a relation between wavelengths of light and periodic intervals of the first electrode.

DESCRIPTION OF THE PREFERRED EMBODIMENTS

Figure 1:
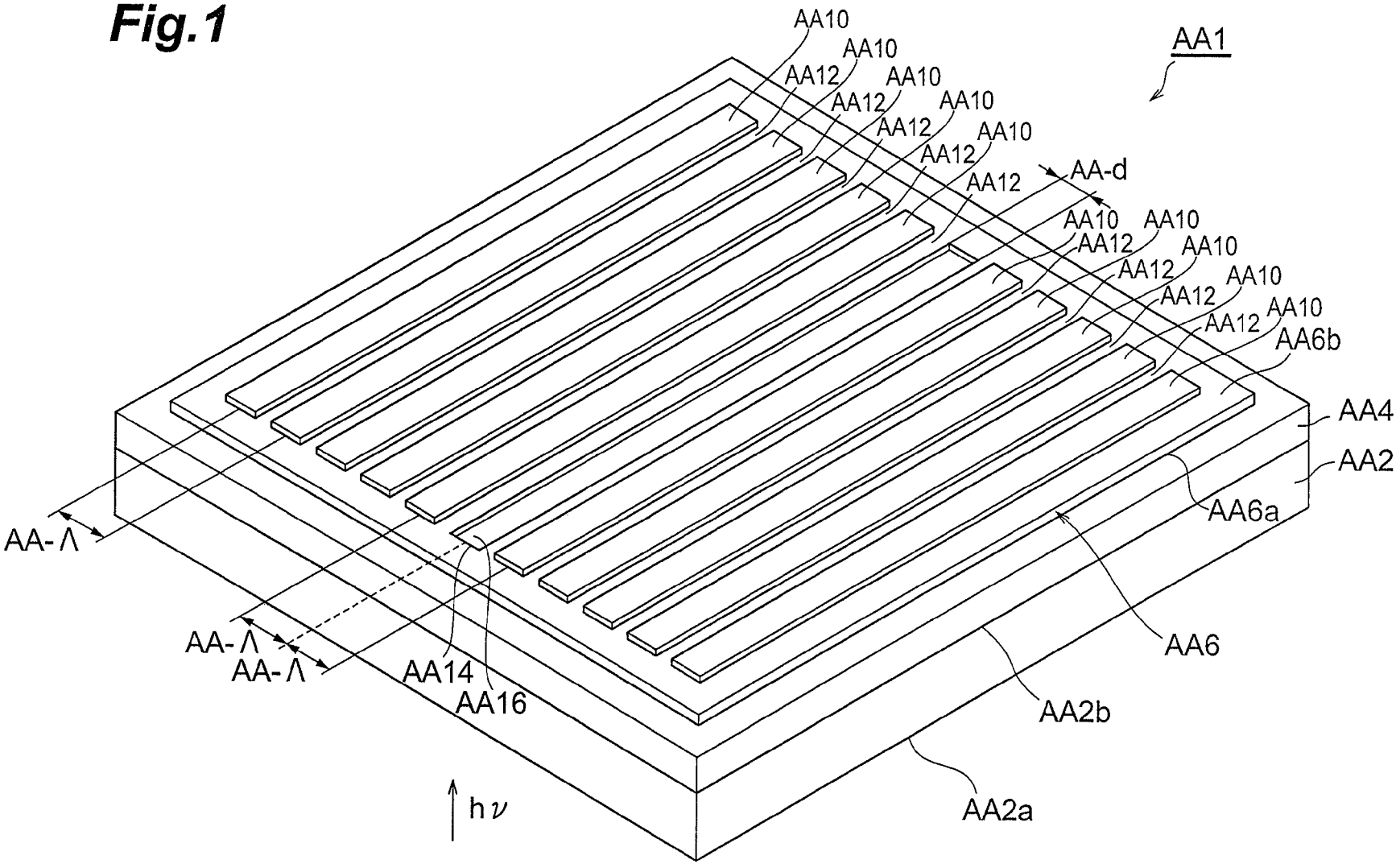
FIG. 1 is a plan view showing a configuration of an embodiment of the photocathode according to the present invention.

Best Mode for Carrying Out the Invention

The preferred embodiments of the photocathode, electron tube, field assist type photocathode, field assist type photocathode array, and field assist type electron tube according to the present invention will be described below in detail with reference to the drawings. It is noted that the terms such as "upper" and "lower" are based on states shown in the drawings and are used for convenience' sake. The photocathode and electron tube according to the present invention will be described in the first embodiment, and the field assist type photocathode, field assist type photocathode array, and field assist type electron tube according to the present invention will be described in the second embodiment.

First Embodiment

Photocathode

FIG. 1 is a perspective view showing a configuration of an embodiment of the photocathode according to the present invention. As shown in FIG. 1, the photocathode AA1 according to the first embodiment has a support substrate AA2, a photoelectric conversion layer AA4 laid on the support substrate AA2, and an antenna layer AA6 laid on the photoelectric conversion layer AA4.

The support substrate AA2 is a member for maintaining the mechanical strength of the photocathode AA1. The support substrate AA2 is, for example, an insulating substrate and is made of a material such as borosilicate glass. The support substrate AA2 has a first principal surface AA2*a* to which incident light (hv) is incident, and a second principal surface AA2*b* opposed to the first principal surface AA2*a*.

The photoelectric conversion layer AA4 is formed on the second principal surface AA2*b* of the support substrate AA2. The photoelectric conversion layer AA4 is a portion to implement photoelectric conversion, and absorbs light to generate photoelectrons ($e^-$). The photoelectric conversion layer AA4 in the first embodiment is made of a p-type GaAs semiconductor and absorbs light in the wavelength range of 200 nm to 930 nm to generate photoelectrons ($e^-$). The photoelectric conversion layer AA4 is of a planar shape.

A part of a surface of the photoelectric conversion layer AA4 is exposed through a through hole AA14 of the antenna layer AA6 described below. An active layer AA16, which is formed as a very thin and uniform layer, is formed on the portion exposed through the through hole AA14 of the photoelectric conversion layer AA4. The active layer AA16 is made, for example, of an alkali metal such as Cs. This active layer AA16 lowers the work function of the surface of the photoelectric conversion layer AA4. For this reason, it becomes easy to output the photoelectrons ($e^-$) generated in the photoelectric conversion layer AA4, through the through hole AA14 of the antenna layer AA6 into vacuum. The material of the active layer AA16 is not always limited to Cs, but the alkali metal may be K, Rb, or Na as well as Cs. The material of the active layer AA16 may also be an oxide of any one of the alkali metals as listed above, or a fluoride of any one of the alkali metals as listed above.

The antenna layer AA6 is provided on the photoelectric conversion layer AA4. The antenna layer AA6 is a layer to induce the surface plasmon resonance, and contains an electroconductive material. The contained electroconductive material is preferably Al, Ag, Au, or the like, but may be any other material.

The antenna layer AA6 has a first principal surface AA6*a* and a second principal layer AA6*b* opposed in the thickness direction. The first principal surface AA6*a* of the antenna layer AA6 is joined to the photoelectric conversion layer AA4. The through hole AA14 penetrating from the first principal surface AA6*a* to the second principal surface AA6*b* is provided in the central region of the antenna layer AA6. The through hole AA14 is of a nearly rectangular shape consisting of longer and shorter sides. The length of the shorter sides of the through hole AA14 (minimum width), AA-d, is shorter than the wavelength of the light incident through the support substrate AA2 and the photoelectric conversion layer AA4 into the antenna layer AA6. This allows only near-field light (which will be detailed later) to be surely outputted from the through hole AA14. Since the through hole AA14 in the present invention is intended for outputting the near-field light, it may also be an optical hole (opening that transmits light), without having to be limited to a physical hole.

The antenna layer AA6 has a plurality of projections AA10, and a recess AA12 located between the projections AA10. The projections AA10 and the recess AA12 are formed in the second principal surface AA6*b* of the antenna layer AA6. The aforementioned through hole AA14 is located in the recess AA12. The plurality of projections AA10 are of a nearly rectangular shape consisting of longer and shorter sides as the through hole AA14 is. The plurality of projections AA10 are one-dimensionally arranged with their longer sides being opposed to each other, and are arranged in symmetry with respect to the through hole AA14. The center distance between projections AA10 adjacent to each other without intervention of the through hole AA14 is AA-Λ, and the center distance between projections AA10 adjacent to each other with the through hole AA14 in between is double AA-Λ. This distance AA-Λ will be referred to hereinafter as a periodic interval. The projections AA10 arranged in this manner and the recess AA12 located between the projections AA10 form a pattern according to a predetermined rule in the second principal surface AA6*b* of the antenna layer AA6. The antenna layer AA6 with the pattern in the surface is able to output the near-field light with the intensity greater than in the case of a flat antenna layer without the projections and recess in the surface.

The periodic interval AA-Λ is properly set according to the wavelength of light to be detected. Let us consider a case in which light of a wavelength $\Lambda_0$ ($=2\pi c/\omega$) is normally incident to the antenna layer AA6. In this case, if the periodic interval AA-Λ of the antenna layer AA6 satisfies Formula (1) below, the surface plasmon resonance takes place with the light of the wavelength $\Lambda_0$ in the antenna layer AA6.

[Mathematical Formula 1]

$$AA-\Lambda = m\lambda_0\sqrt{\frac{\varepsilon_a+\varepsilon_{metal}}{\varepsilon_a\cdot\varepsilon_{metal}}} \quad (1)$$

In the equation, $\in_a$ is the relative dielectric constant of a dielectric in contact with the antenna layer AA6 and in vacuum $\in_a=1$. Furthermore, $\in_{metal}$ is the relative dielectric constant of the antenna layer AA6 and $\in_{metal}>0$. Therefore, we can derive Formula (2) below.

[Mathematical Formula 2]

$$AA\text{-}\Lambda<\lambda_0 \quad (2)$$

According to Formula (2), for inducing the surface plasmon resonance with the light of the wavelength $\Lambda_0$, it is necessary to set the periodic interval AA-Λin the antenna layer AA6 shorter than the wavelength $\Lambda_0$. It is seen from this fact that the length (width) AA-d of the shorter sides of the through hole AA14 also needs to be shorter than the wavelength $\Lambda_0$.

FIG. 2 shows a relation between the periodic interval AA-Λ and the wavelength $\Lambda_0$ of light in cases where m in Formula (1) is 1 and where the antenna layer AA6 is made of Ag or Al. It is apparent from FIG. 2 that the periodic interval AA-Λ should be set at 1234 nm in the Ag case in order to induce the surface plasmon resonance with the light of the wavelength $\Lambda_0$=1240 nm in the antenna layer AA6. In the first embodiment, the periodic interval AA-Λ of the antenna layer AA6 is so set that the surface plasmon resonance takes place with the light of the wavelength λ and that the wavelength of the near-field light outputted from the through hole AA14 of the antenna layer AA6 according to the surface plasmon resonance falls within the range of 200 nm to 930 nm.

Figure 3:
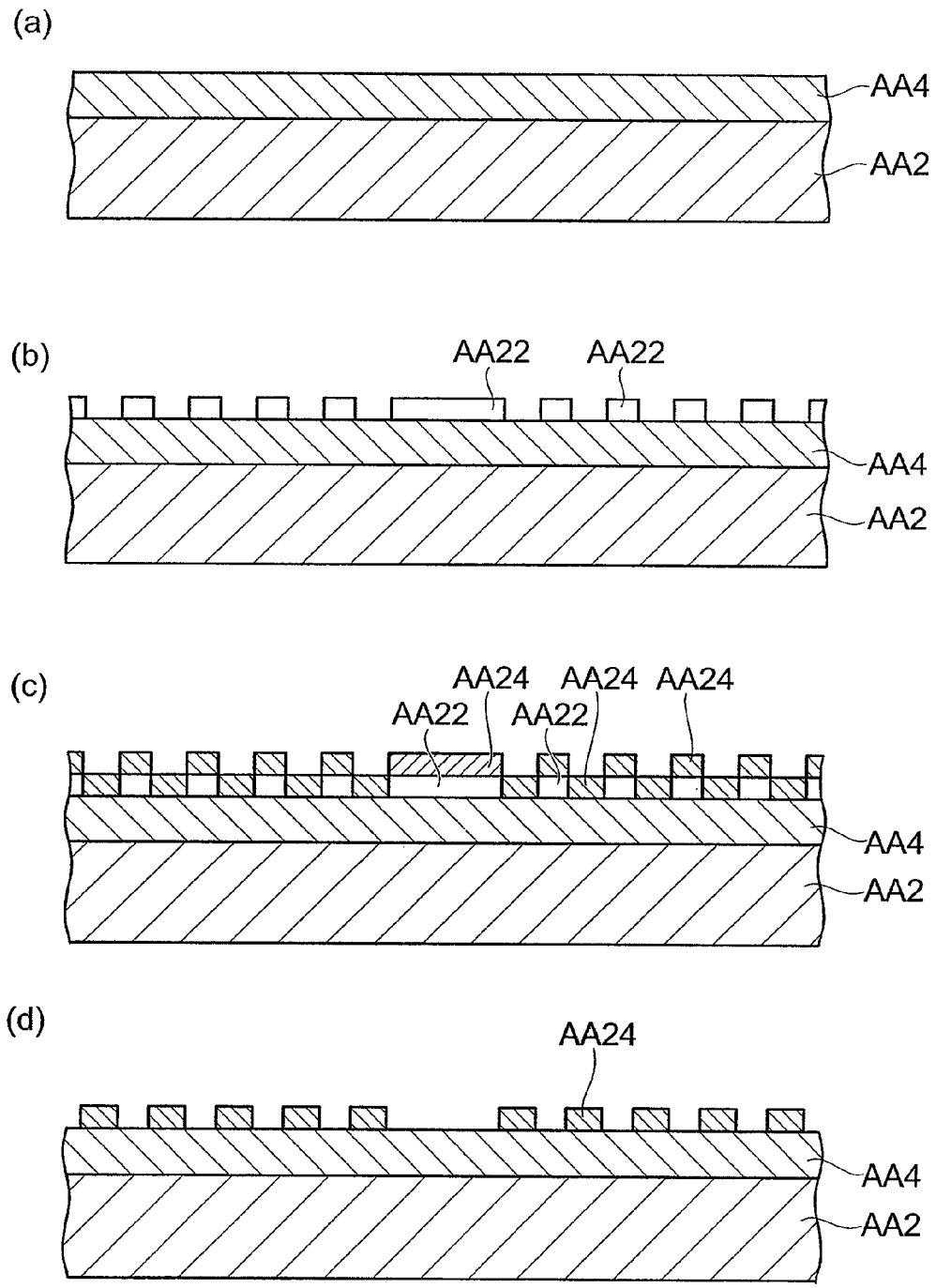
FIG. 3 is sectional views showing steps of manufacturing the photocathode shown in FIG. 1.

Subsequently, steps of manufacturing the photocathode AA1 will be explained. The first step, as shown in FIG. 3 (*a*), is to prepare the support substrate AA2 made of borosilicate glass. The photoelectric conversion layer AA4 of a p-type GaAs semiconductor is then laid on the prepared support substrate AA2. A method of laying the photoelectric conversion layer AA4 of the p-type GaAs semiconductor on the support substrate AA2 is not described in detail herein, but can be one of the well-known methods, for example, the method as disclosed in Japanese Patent Application Laid-open No. H9-180633.

The next step, as shown in FIG. 3 (*b*), is to apply a photoresist AA22 and thereafter effect such patterning of the photoresist AA22 that openings are made in the regions where the projections AA10 are to be formed. The subsequent step, as shown in FIG. 3 (*c*), is to effect evaporation to deposit an electroconductive film AA24 containing Al, Ag, Au, or the like, on the photoelectric conversion layer AA4 masked by the photoresist AA22. The patterning of the photoresist AA22 may be implemented by photolithography with ultraviolet light or the like, or by electron beam lithography with an electron beam.

Figure 4:
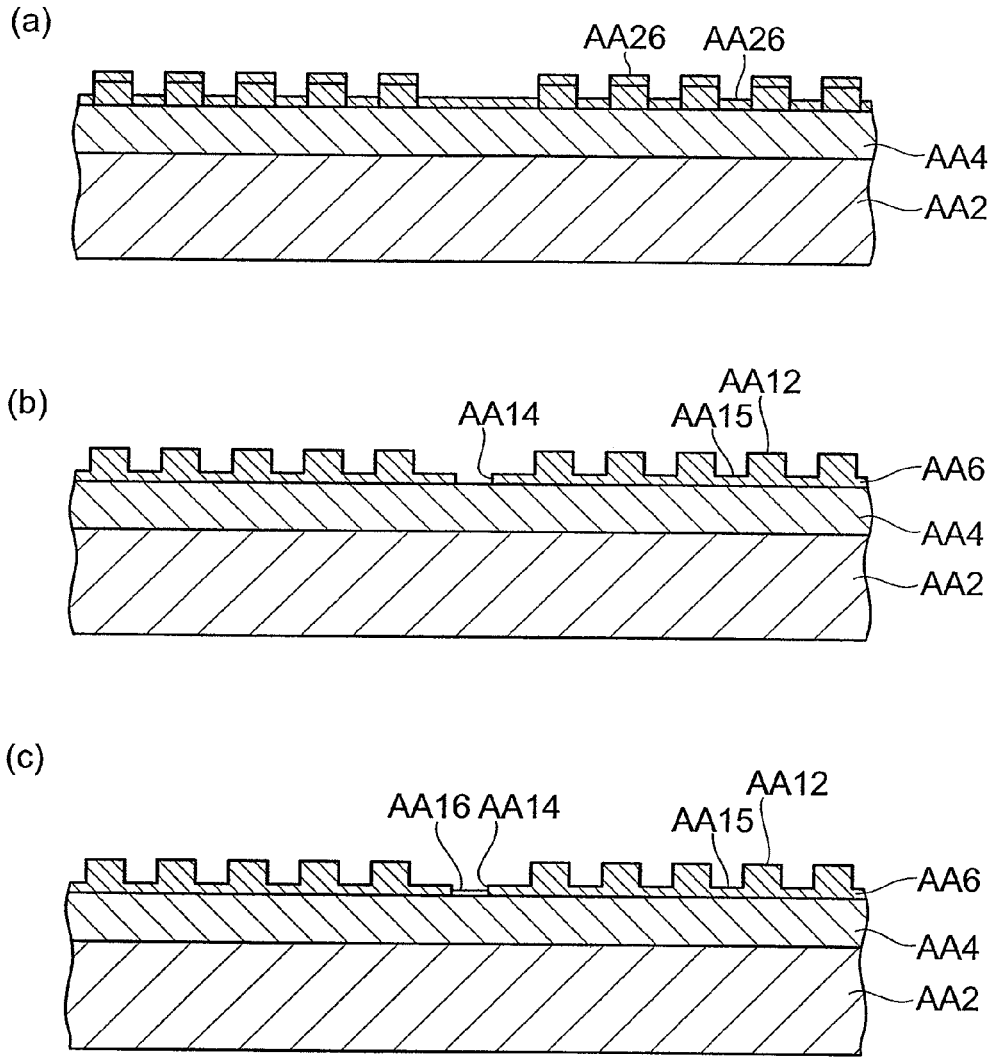
FIG. 4 is sectional views showing the steps subsequent to FIG. 3.

The next step, as shown in FIG. 3 (*d*), is to effect lift-off removal of portions of the electroconductive film AA24 deposited on the photoresist AA22, together with the photoresist AA22. After the lift-off removal, an electroconductive film AA26 of the same material as the electroconductive film AA24 is deposited by evaporation, as shown in FIG. 4 (*a*). This results in forming the projections AA10 and the recess AA12.

After the deposition of the electroconductive film AA26, a portion where the through hole AA14 is to be formed is irradiated with a focused ion beam (FIB) to remove the electroconductive film AA26 from this portion, as shown in FIG. 4 (*b*). This results in forming the antenna layer AA6 with the through hole AA14.

The next step, as shown in FIG. 4 (*c*), is to form the active layer AA16 of an alkali metal such as Cs, on the portion exposed through the through hole AA14 of the photoelectric conversion layer AA4. The photocathode AA1 shown in FIG. 1 is completed through the above steps.

Subsequently, the operation of the photocathode AA1 will be described. When light (hv) is incident from the first principal surface AA2*a* side of the support substrate AA2, the incident light (hv) passes through the support substrate AA2 and the photoelectric conversion layer AA4 to reach the antenna layer AA6. When the incident light (hv) reaches the surface with the pattern comprised of the projections AA10 and the recess AA12, i.e., the second principal surface AA6*b* of the antenna layer AA6, light of the wavelength λ included in the incident light (hv) couples with surface plasmons in the antenna layer AA6. This results in inducing the surface plasmon resonance in the antenna layer AA6.

When the surface plasmon resonance takes place, the antenna layer AA6 outputs strong near-field light from the through hole AA14. A direction of output of the near-field light is a direction from the pattern-formed surface toward the surface without the pattern, i.e., a direction from the second principal surface AA6*b* to the first principal surface AA6*a*. The wavelength of the near-field light outputted from the through hole AA14 is dependent upon the periodic interval AA-Λ of the pattern formed in the surface of the antenna layer AA6 and is in the range of 200 nm to 930 nm. The intensity of this near-field light is proportional to and greater than the intensity of the light of the wavelength λ.

The photoelectric conversion layer AA4 joined to the first principal surface AA6*a* of the antenna layer AA6 receives the near-field light outputted from the through hole AA14 of the antenna layer AA6. Since the wavelength of the near-field light is in the range of 200 nm to 930 nm, the photoelectric conversion layer AA4 of the p-type GaAs semiconductor can absorb the near-field light. The region around the through hole AA14 in the photoelectric conversion layer AA4 absorbs the near-field light to generate photoelectrons ($e^-$) in an amount according to the intensity of the near-field light (quantity of received light).

The near-field light outputted from the through hole AA14 of the antenna layer AA6 has the very large intensity, for example, as compared with that of light outputted from a through hole of an antenna layer when light (hv) is incident to the fat antenna layer without the projections and the recess in its surface. For this reason, an amount of photoelectrons ($e^-$) generated in the region around the through hole AA14 is much larger than an amount of photoelectrons ($e^-$) generated in the case using the foregoing antenna layer with the flat surface instead of the antenna layer AA6.

The active layer AA16 is formed on the portion exposed through the through hole AA14 of the photoelectric conversion layer AA4. The active layer AA16 lowers the work function of the surface of the photoelectric conversion layer AA4. For this reason, the photoelectrons ($e^-$) generated in the region around the through hole AA14 in the photoelectric conversion layer AA4 are readily outputted through the through hole AA14.

As described above, the photocathode AA1 of the first embodiment has the photoelectric conversion layer AA4 and the antenna layer AA6. The pattern comprised of the projections AA10 and the recess AA12 is formed in the second principal surface AA6*b* of the antenna layer AA6. The antenna layer AA6 with the pattern induces the surface plasmon resonance with the light of the wavelength λ and outputs the near-field light of the wavelength in the range of 200 nm to 930 nm dependent upon the periodic interval AA-Λ of the pattern of the antenna layer AA6. When the light (hv) is incident to the second principal surface AA6*b* of the antenna layer AA6, the light of the wavelength λ included in the incident light (hv) couples with surface plasmons in the antenna layer AA6. This induces the surface plasmon resonance in the antenna layer AA6. When the surface plasmon resonance takes place, the strong near-field light is outputted from the through hole AA14 of the antenna layer AA6. The near-field light is received by the photoelectric conversion layer AA4. Since the wavelength of the near-field light is in the range of 200 nm to 930 nm dependent upon the periodic interval AA-Λ of the pattern of the antenna layer AA6, the photoelectric conversion layer AA4 made of such a well-known material as the p-type GaAs semiconductor can absorb the near-field light to generate photoelectrons ($e^-$). Therefore, there is no need for preparing the photoelectric conversion layer AA4 of a special material, and it can facilitate the manufacture of the photocathode AA1.

The photoelectric conversion layer AA4 absorbs the near-field light to generate photoelectrons ($e^-$) in the amount according to the intensity of the near-field light. The photoelectrons ($e^-$) by the near-field light are generated in the region around the through hole AA14 in the photoelectric conversion layer AA4. This causes the photoelectrons ($e^-$) generated in the region around the through hole AA14, i.e., the photoelectrons ($e^-$) by the near-field light to be outputted through the through hole AA14. The intensity of the near-field light is proportional to and greater than the intensity of the light of the wavelength λ included in the incident light (hv). Therefore, the region around the through hole AA14 in the photoelectric conversion layer AA4 generates a sufficient amount of photoelectrons ($e^-$), so that a sufficient amount of photoelectrons ($e^-$) are outputted through the through hole AA14 of the antenna layer AA6. In the photocathode AA1, the photoelectrons ($e^-$) are outputted only through the through hole AA14, and, for example, thermal electrons generated by heat or the like independent of incident light are also outputted only through the through hole AA14. For this reason, a dark current, which becomes noise, is significantly weaker than that in the case without the antenna layer AA6. Therefore, the photocathode AA1 of the present invention is able to detect the light of the wavelength λ at high S/N ratios and demonstrates an excellent detection sensitivity for the light of the wavelength λ.

The present invention is not limited to the above embodiment, but can be modified in many ways. For example, the photoelectric conversion layer AA4 in the first embodiment was made of the p-type GaAs semiconductor, but the material of the photoelectric conversion layer AA4, without always being limited to it, may be any one of such compound semiconductors as InGaAs, GaAsP, GaN, InGaN, and AlGaN, and mixed crystals thereof. The photoelectric conversion layer AA4 may be of a heterostructure consisting of a stack of layers made of these semiconductors. The material and structure of the photoelectric conversion layer AA4 are appropriately selected according to the wavelength of the near-field light outputted from the antenna layer AA6 and application of the photocathode AA1.

In the first embodiment the support substrate AA2 was made of borosilicate glass, but the material of the support substrate AA2, without being limited to it, may be any one of semiconductor materials and oxide materials as long as it can maintain the mechanical strength of the photocathode AA1.

Figure 5:
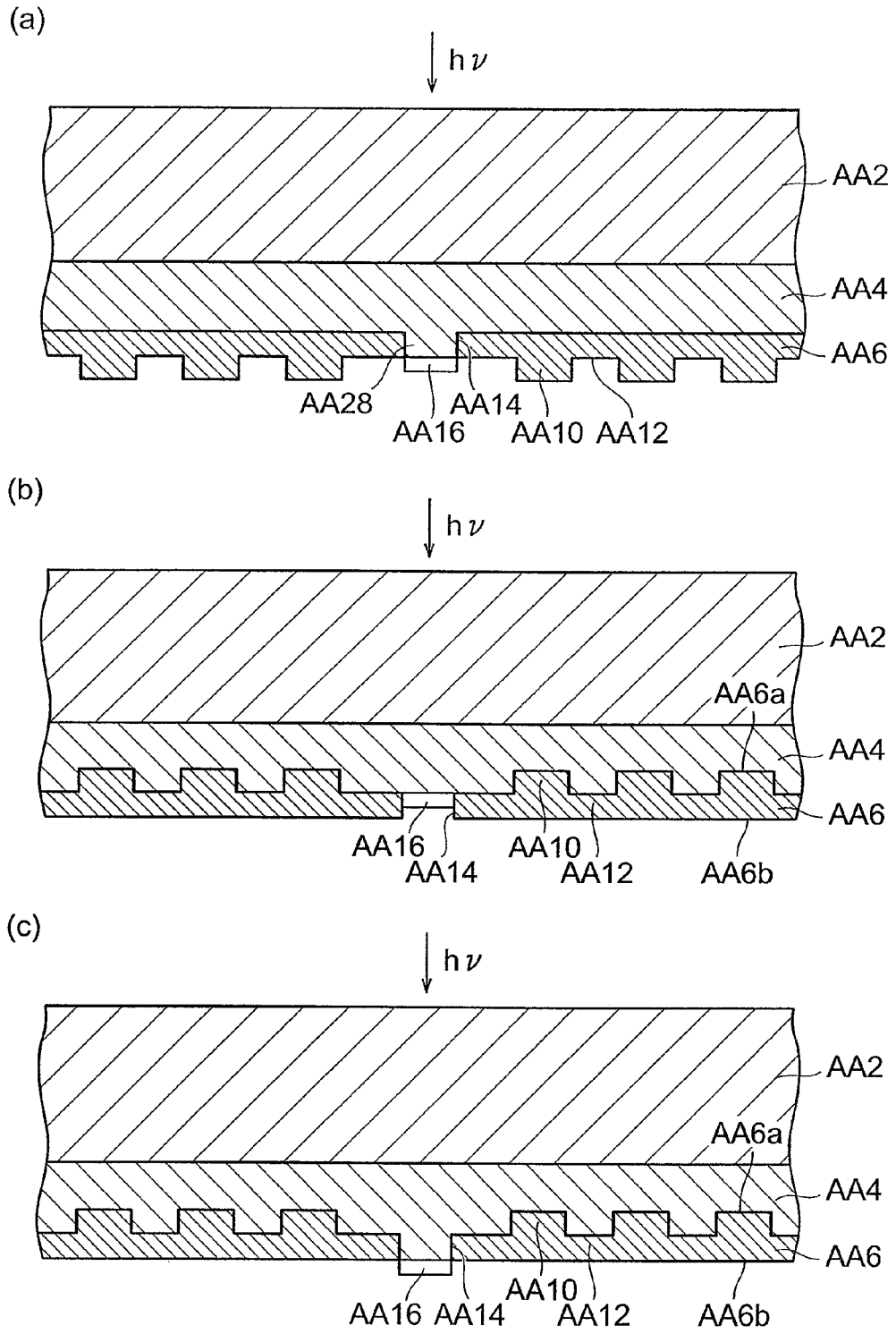
FIG. 5 is a drawing showing modification examples of the photoelectric conversion layer and the antenna layer in the photocathode according to the first embodiment.

In the first embodiment the photoelectric conversion layer AA4 was of the planar shape. This may be modified, as shown in FIG. 5 (*a*), so that the photoelectric conversion layer AA4 has a mesa portion AA28 at the position opposite to the through hole AA14 of the antenna layer AA6. In the first embodiment, the projections AA10 and the recess AA12 were formed in the second principal surface AA6*b* of the antenna layer AA6. This may be modified, as shown in FIG. 5 (*b*), so that the projections AA10 and the recess AA12 are formed in the first principal surface AA6*a* of the antenna layer AA6. In the configuration where the projections AA10 and the recess AA12 are formed in the first principal surface AA6*a* of the antenna layer AA6, the photoelectric conversion layer AA4 may be formed, as shown in FIG. 5 (*c*), so as to fill the through hole AA14 of the antenna layer AA6. Furthermore, a Bragg reflecting layer may be formed around the antenna layer AA6.

Figure 6:
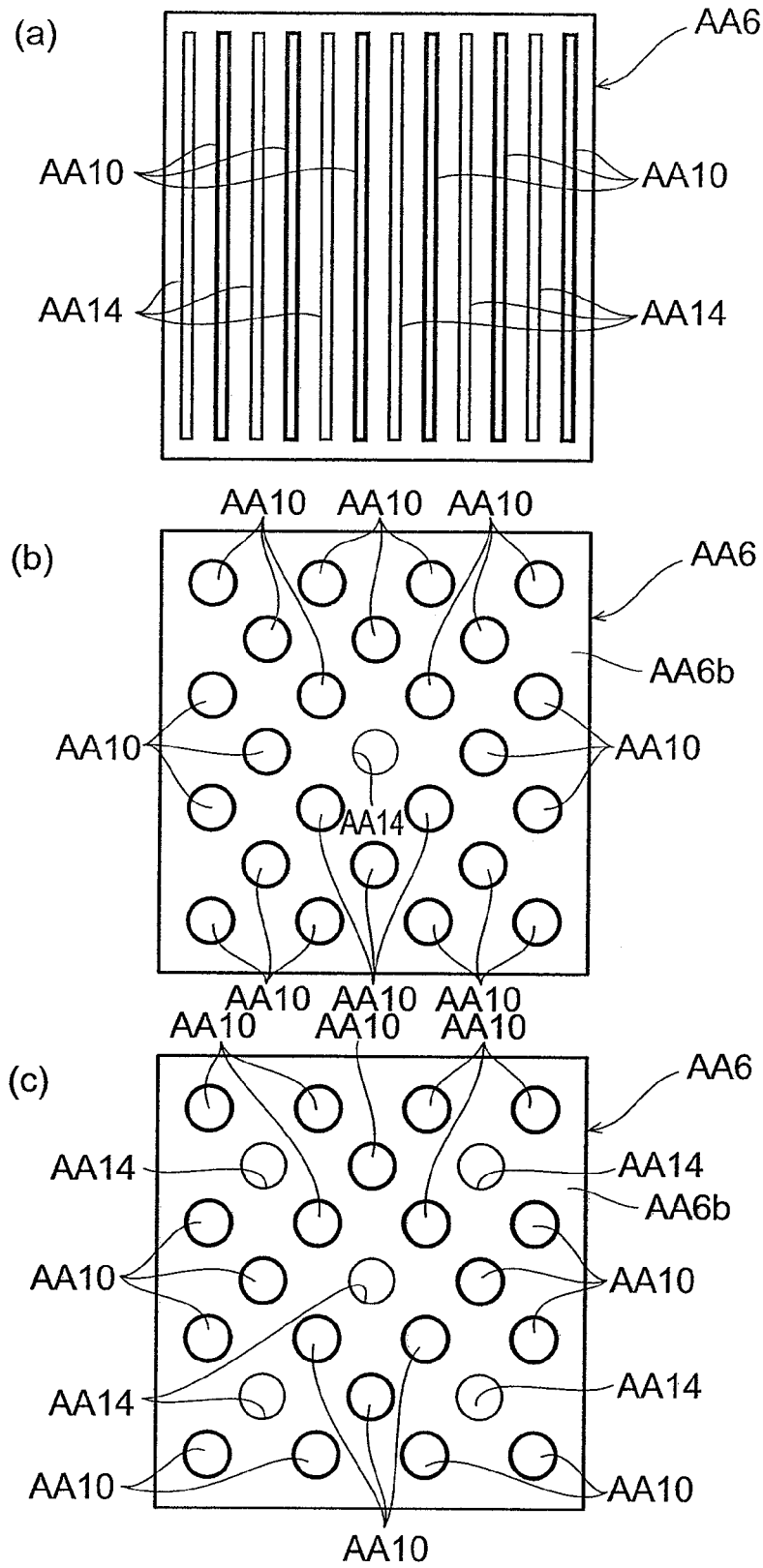
FIG. 6 is a drawing showing modification examples of the antenna layer in the photocathode according to the first embodiment.
Figure 7:
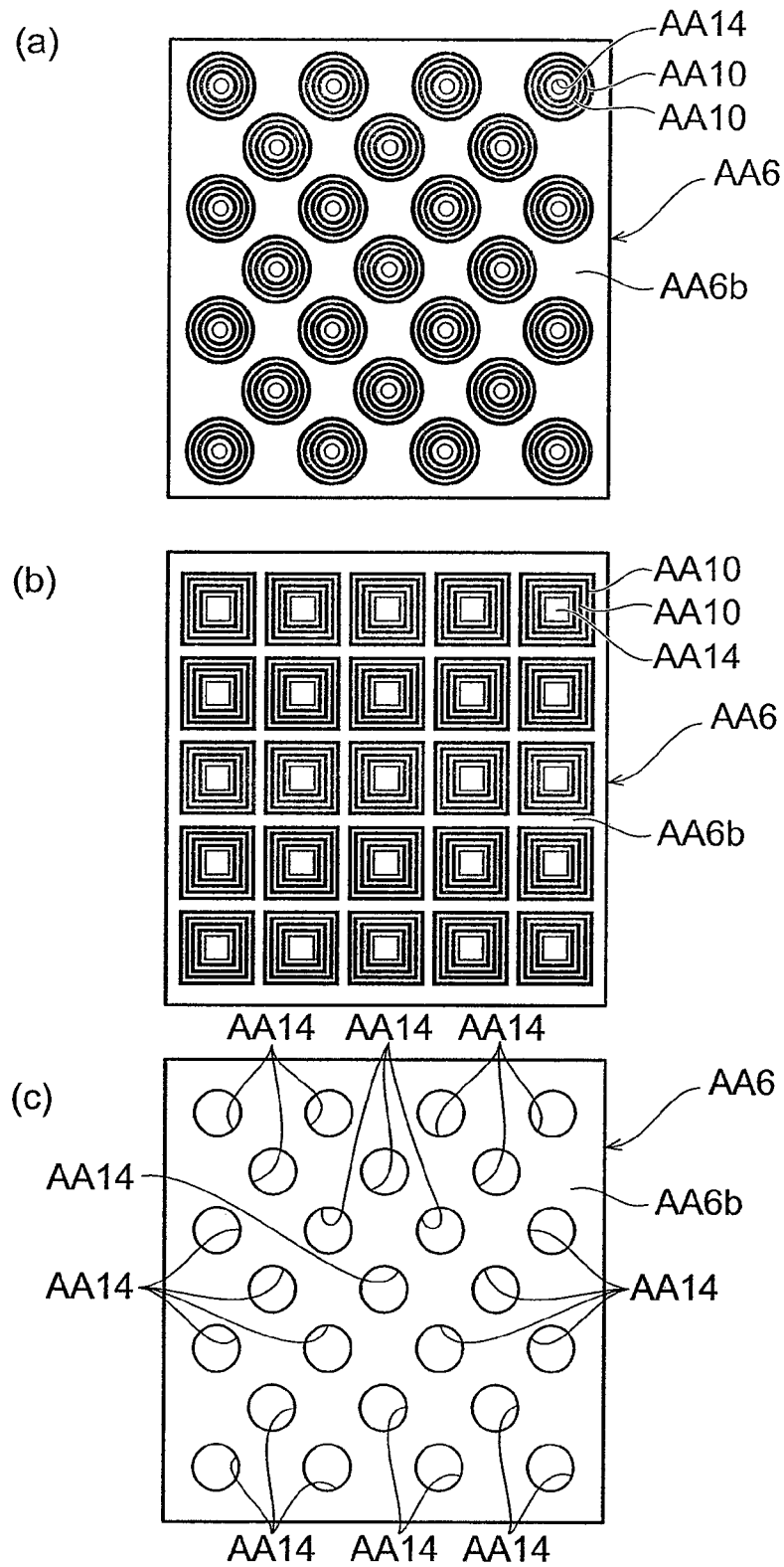
FIG. 7 is a drawing showing other modification examples of the antenna layer in the photocathode according to the first embodiment.

The pattern in the surface of the antenna layer AA6 is not always limited to that in the first embodiment. For example, as shown in FIG. 6 (*a*), it may be a pattern formed by one-dimensionally arranging projections AA10 of a nearly rectangular shape at even intervals and providing through holes AA14 of a nearly rectangular shape in respective recesses AA12 located between the projections AA10. It may also be a pattern, as shown in FIG. 6 (*b*), formed by locating a through hole AA14 of a nearly circular shape in the center and two-dimensionally arranging projections AA10 of a nearly circular shape at even intervals around the through hole AA14, or a pattern, as shown in FIG. 6 (*c*), formed by two-dimensionally arranging through holes AA14 of a nearly circular shape and projections AA10 of a nearly circular shape in an alternate manner and at even intervals. The diameter (minimum width) of the through holes AA14 of the nearly circular shape should be shorter than the wavelength of the light incident to the antenna layer AA6. The pattern may also be one, as shown in FIG. 7 (*a*), formed by two-dimensionally arranging darts marks (also called bull's eyes), each mark consisting of a through hole AA14 and a plurality of projections AA10, at predetermined intervals. FIG. 7 (*b*) shows a modification of the pattern of FIG. 7 (*a*) into a rectangular shape.

In the photocathode AA1 of the first embodiment, the pattern in the surface of the antenna layer AA6 was formed by the plurality of projections AA10 and the recess AA12 located between the projections AA10. It may be modified so that the pattern in the surface of the antenna layer AA6 is formed by a plurality of through holes AA14. When the pattern in the surface of the antenna layer AA6 is formed by two-dimensionally arranging the through holes AA14 at even intervals (predetermined intervals) as shown in FIG. 7 (*c*), the shape of the pattern in the antenna layer AA6 can be modified by varying the locations and arrangement intervals of the through holes AA14.

Figure 8:
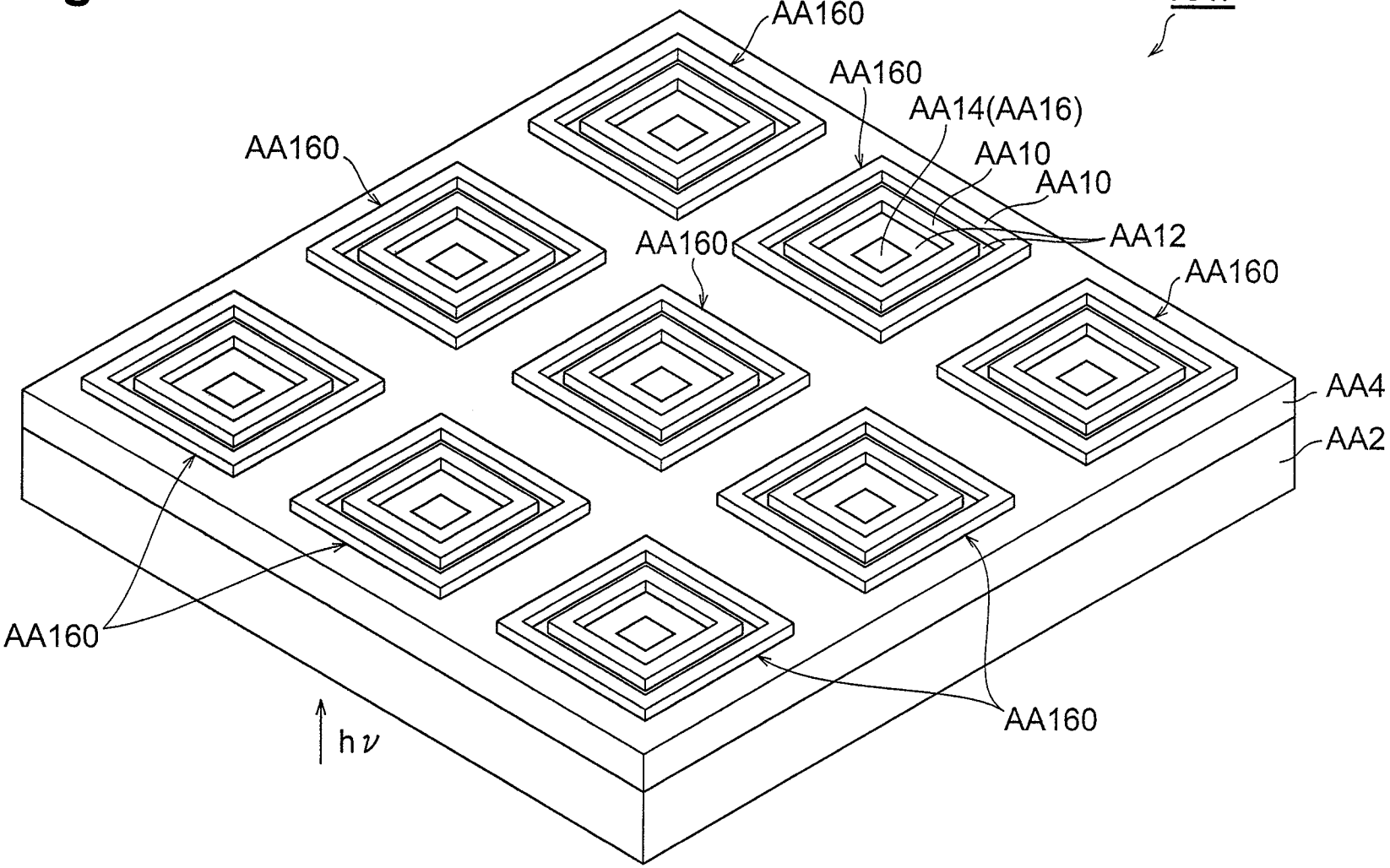
FIG. 8 is a drawing showing another modification example of the antenna layer in the photocathode according to the first embodiment.
Figure 9:
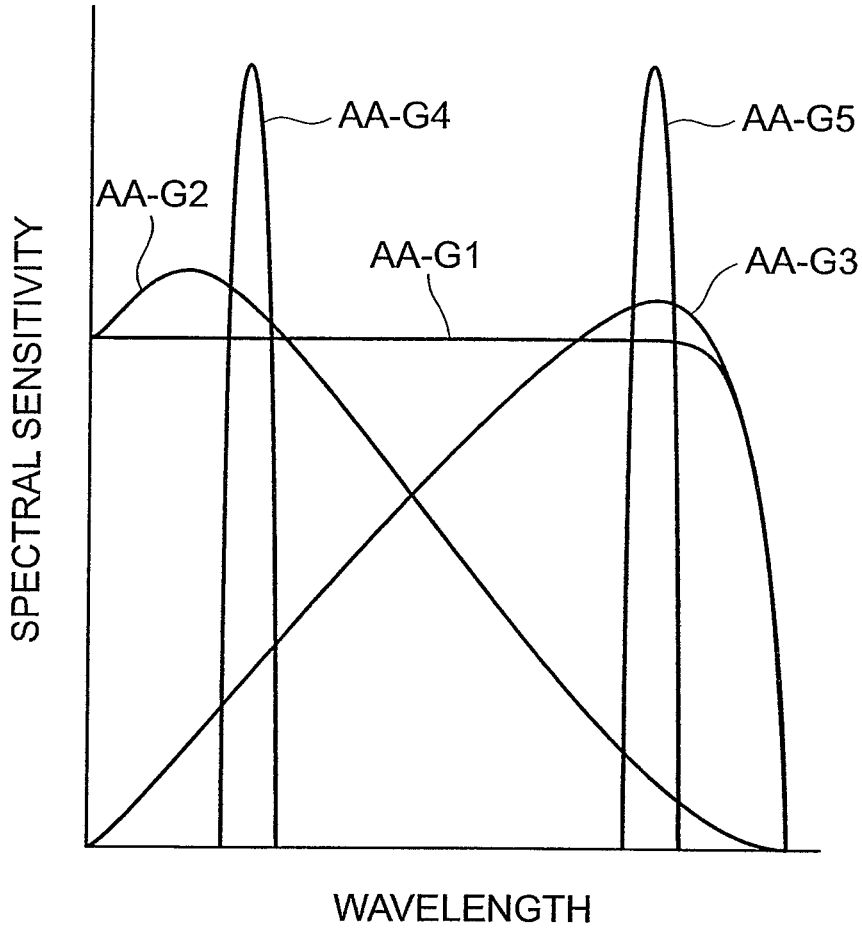
FIG. 9 is a graph showing spectral sensitivity characteristics of photocathodes with different patterns of the antenna layer in the photocathodes according to the first embodiment.

Besides, as shown in FIG. 8, the photocathode AA1 may be one with a plurality of antenna layers AA160 in each of which projections AA10 and recesses AA12 are formed. In this case, the surface plasmon resonance takes place in each antenna layer AA160 to output the near-field light. FIG. 9 is a graph showing spectral sensitivity characteristics of photocathodes with changes in the shape of the pattern of the antenna layer. By properly changing the shape of the pattern, we can obtain various photocathodes as follows: a photocathode with a relatively wide sensitivity wavelength range and flat sensitivities, as indicated by curve AA-G1 in FIG. 9; a photocathode with a relatively wide sensitivity wavelength range and high spectral sensitivities on the short wavelength side, as indicated by curve AA-G2; a photocathode with a relatively wide sensitivity wavelength range and high spectral sensitivities on the long wavelength side, as indicated by curve AA-G3; a photocathode with a spectral sensitivity only at a specific wavelength on the short wavelength side, as indicated by curve AA-G4; a photocathode with a spectral sensitivity only at a specific wavelength on the long wavelength side, as indicated by curve AA-G5.

(Image Intensifier)

Figure 10:
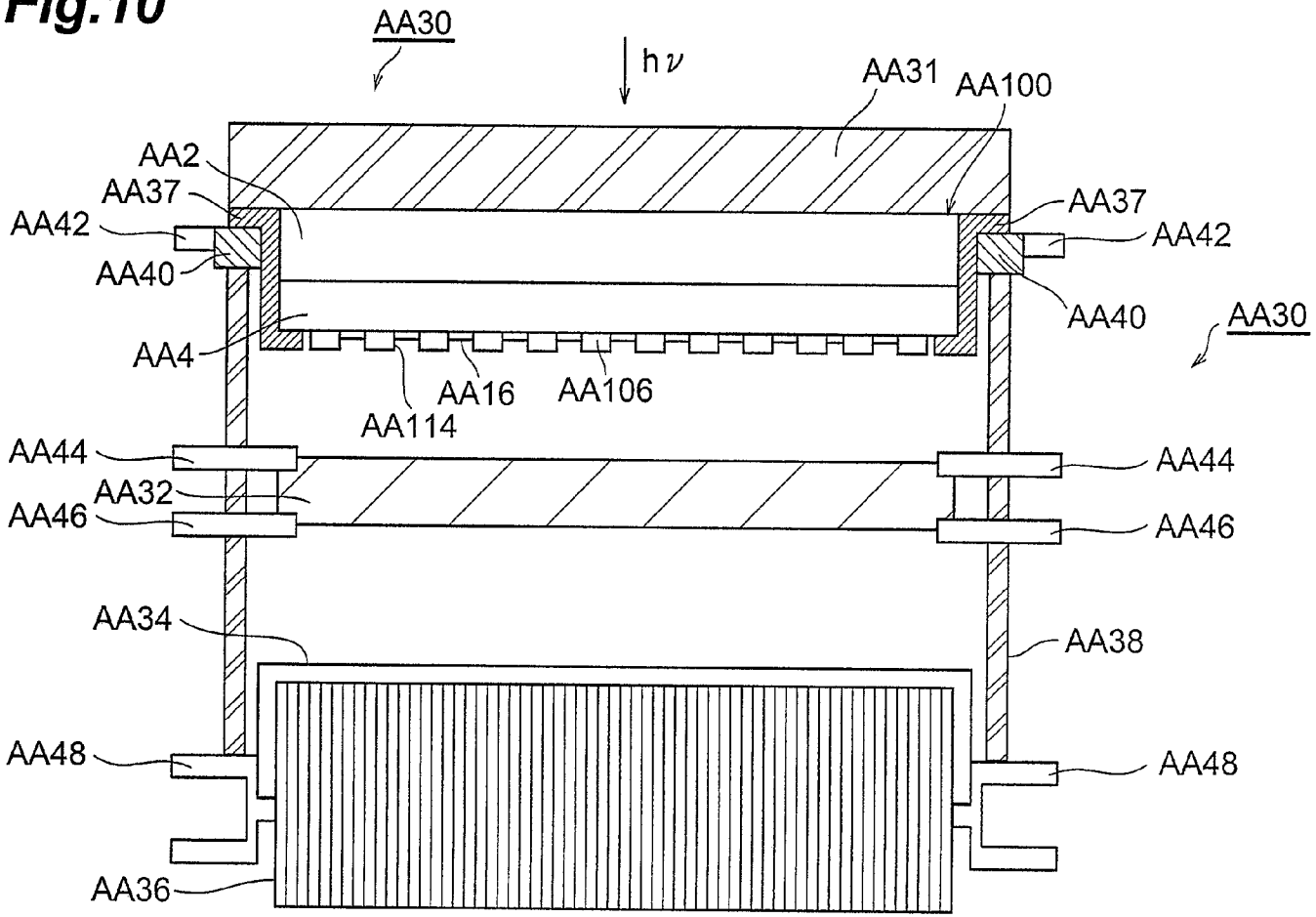
FIG. 10 is a sectional schematic view of an image intensifier according to the first embodiment of the present invention.

An image intensifier will be described below. FIG. 10 is a sectional schematic view of an image intensifier AA30. The image intensifier AA30 has a glass face plate AA31, a photocathode AA100, a micro channel plate (MCP) AA32, a phosphor AA34, a glass fiber plate AA36, and a vacuum container AA38.

The photocathode AA100 has a support substrate AA2, a photoelectric conversion layer AA4 laid on the support substrate AA2, and an antenna layer AA106 laid on the photoelectric conversion layer AA4. The antenna layer AA106 is formed by two-dimensionally arranging through holes AA114 at even intervals (predetermined intervals) like the antenna layer AA6 shown in FIG. 7 (*c*). An active layer AA16, which is formed as a very thin and uniform layer, covers each of portions of the photoelectric conversion layer AA4 exposed through the through holes AA114.

The glass face plate AA31 is supported at one end of the vacuum container AA38, and the glass face plate AA31 and the vacuum container AA38 are sealed with a seal portion AA40 of In or the like. The interior of the sealed vacuum container AA38 is vacuum. Inside the vacuum container AA38, the photocathode AA100, micro channel plate AA32, phosphor AA34, and glass fiber plate AA36 are disposed in order from the glass face plate AA31 side. The photocathode AA100 is mounted at one end inside the vacuum container AA38 so that the support substrate AA2 is located on the glass face plate AA31 side and that the antenna layer AA106 is located on the micro channel plate AA32 side. An electrode AA37 is connected to the periphery of the photoelectric conversion layer AA4 in the photocathode AA100. The electrode AA37 is connected to an electrode AA42. The micro channel plate AA32 and phosphor AA34 are provided with a plurality of electrodes AA44, AA46, AA48 for providing desired potentials.

A voltage of several hundred V is applied between the photocathode AA100 and the micro channel plate AA32 through the electrode AA42 and electrode AA44. A voltage for multiplication is applied between the upper side (hereinafter referred to as "input side") of the micro channel plate AA32 and the lower side (hereinafter referred to as "output side") of the micro channel plate AA32 through the electrodes AA44, AA46 connected to the micro channel plate AA32. A voltage of about several kV is applied between the micro channel plate AA32 and the phosphor AA34 through the electrode AA46 connected to the micro channel plate AA32 and the electrode AA48 connected to the phosphor AA34.

The following will describe the operation of the image intensifier AA30 having the configuration as described above. When light (hv) is incident to the glass face plate AA31 serving as an entrance window of the image intensifier AA30, the incident light (hv) travels through the glass face plate AA31, the support substrate AA2 of the photocathode AA100, and the photoelectric conversion layer AA4 of the photocathode AA100 to reach the antenna layer AA106 of the photocathode AA100. When the incident light (hv) reaches the antenna layer AA106, the surface plasmon resonance takes place in the antenna layer AA 106 with the light of the wavelength λ included in the incident light (hv). This results in outputting the strong near-field light from the through holes AA114 of the antenna layer AA106. The wavelength of the output near-field light is in the range of 200 nm to 930 nm and is the one that can be absorbed in the well-known photoelectric conversion layer AA4 made of such a material as the p-type GaAs semiconductor.

The near-field light is outputted in the direction from the second principal surface AA6*b* to the first principal surface AA6*a* of the antenna layer AA106 and is received by the photoelectric conversion layer AA4. The regions around the through holes AA114 in the photoelectric conversion layer AA4 receive the near-field light and generate photoelectrons ($e^-$) in an amount according to the intensity of the near-field light (quantity of received light). The photoelectrons ($e^-$) generated in the regions around the through holes AA114 in the photoelectric conversion layer AA4 are outputted through the active layers AA16 from the through holes AA114. The intensity of the near-field light is proportional to and larger than the intensity of the light of the wavelength λ included in the incident light (hv). Therefore, the regions around the through holes AA114 in the photoelectric conversion layer AA4 generate a sufficient amount of photoelectrons ($e^-$), so that a sufficient amount of photoelectrons ($e^-$) are outputted through the through holes AA114 of the antenna layer AA106.

The photoelectrons ($e^-$) outputted into vacuum, while being accelerated by the voltage applied between the photocathode AA100 and the micro channel plate AA32, impinge upon the micro channel plate AA32. The incident photoelectrons ($e^-$) are subjected to secondary electron multiplication by the micro channel plate AA32 and are again outputted into vacuum. Then they, while being accelerated by the voltage applied between the micro channel plate AA32 and the phosphor AA34, impinge upon the phosphor AA34 to cause emission of light. The light emitted from the phosphor AA34 is led through the glass fiber plate AA36 to the outside of the image intensifier AA30.

As described above, the image intensifier AA30 of the first embodiment has the photocathode AA100. The photocathode AA100 has the antenna layer AA106 to induce the surface plasmon resonance. The photocathode AA 100 having the antenna layer AA 106 outputs a sufficient amount of photoelectrons ($e^-$) according to incidence of the light of the specific wavelength. In the image intensifier AA30, the photoelectrons ($e^-$) are outputted only through the through holes AA114 of the photocathode AA100. Likewise, for example, the thermal electrons generated by heat or the like independent of the incident light are also outputted only through the through holes AA114. For this reason, the dark current to become noise is much smaller than that in the case without the antenna layer AA106. Therefore, the image intensifier AA30 is able to detect the light of the specific wavelength at high S/N ratios. The present invention thus provides the image intensifier with an excellent detection sensitivity for the light of the specific wavelength.

The present invention is not limited to the above embodiment but may be modified in many ways. For example, the image intensifier AA30 of the first embodiment used the photocathode AA100 as a transmission type photocathode, which outputs the photoelectrons ($e^-$) from the surface opposite to the entrance surface of the incident light (hv), but the photocathode AA100 may be used as a reflection type photocathode which outputs the photoelectrons ($e^-$) from the entrance surface of the incident light (hv).

(Line Focus Type Photomultiplier Tube)

Figure 11:
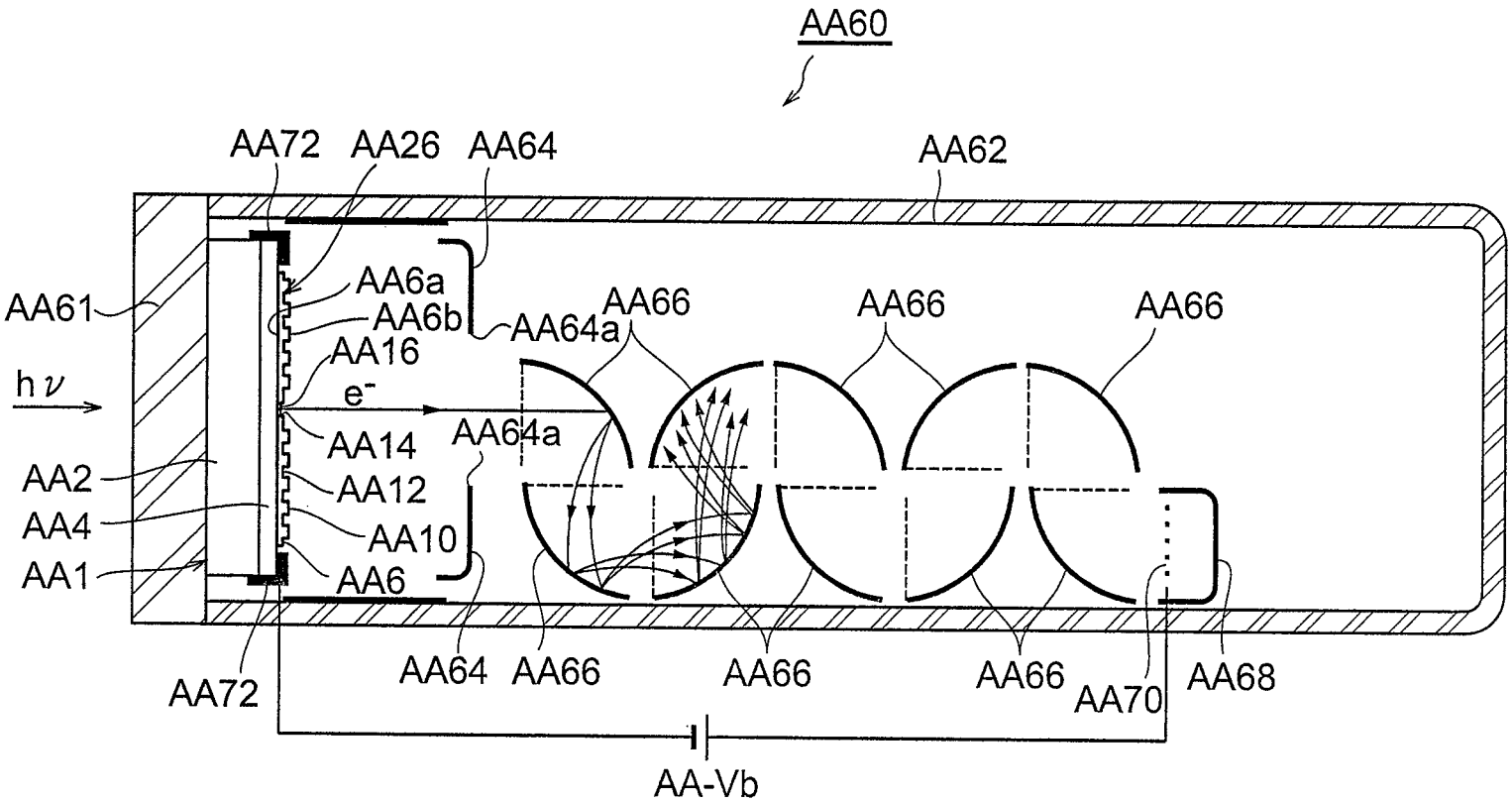
FIG. 11 is a sectional schematic view of a line focus type photomultiplier tube according to the first embodiment of the present invention.

A line focus type photomultiplier tube will be described below. FIG. 11 is a sectional schematic view of a photomultiplier tube AA60. The photomultiplier tube AA60 has a glass face plate AA61, the photocathode AA1 of the aforementioned embodiment, a vacuum container AA62, a focusing electrode AA64, a plurality of dynodes AA66, a final dynode AA68, and an anode electrode AA70. The glass face plate AA61 is supported at one end of the vacuum container AA62, and the glass face plate AA61 and the vacuum container AA62 are sealed. The interior of the sealed vacuum container AA62 is vacuum. Inside the vacuum container AA62, the photocathode AA1, the focusing electrode AA64, the plurality of dynodes AA66, and the final dynode AA68 are disposed in order from the glass face plate AA61 side. The photocathode AA1 is mounted at one end of the vacuum container AA62 so that the support substrate AA2 is located on the glass face plate AA61 side and that the antenna layer AA6 is located inside. A cathode electrode AA72 is connected to the periphery of the photoelectric conversion layer AA4 in the photocathode AA1. The anode electrode AA70 and the cathode electrode AA72 are connected through an external circuit and are arranged to be able to apply a bias voltage AA-Vb.

The focusing electrode AA64 is disposed inside the vacuum container AA62 so as to face the photocathode AA1 with a predetermined distance between them. An aperture AA64*a* is provided in the central part of the focusing electrode AA64. The plurality of dynodes AA66 are electron multiplying means for receiving photoelectrons ($e^-$) emitted from the photocathode AA1, to generate secondary electrons, or for receiving secondary electrons from another dynode AA66 to generate a greater number of secondary electrons. The plurality of dynodes AA66 are of a curved shape and multiple stages of dynodes AA66 are repetitively arranged so that secondary electrons emitted from each dynode AA66 are received by another dynode AA66. The final dynode AA68 is a part that finally receives secondary electrons after multiplied by the plurality of dynodes AA66. The anode electrode AA70 is connected to the final dynode AA68 and to an unrepresented stem pin.

The following will describe the operation of the photomultiplier tube AA60 having the configuration as described above. When light (hv) is incident to the glass face plate AA61 of the photomultiplier tube AA60, the incident light (hv) travels through the glass face plate AA61, the support substrate AA2 of the photocathode AA1, and the photoelectric conversion layer AA4 of the photocathode AA1 to reach the antenna layer AA6 of the photocathode AA1. When the incident light (hv) impinges upon the surface with the pattern comprised of the projections AA10 and the recess AA12 in the antenna layer AA6, i.e., the second principal surface AA6*b* of the antenna layer AA6, the surface plasmon resonance takes place in the antenna layer AA6 with the light of the wavelength included in the incident light (hv). This results in outputting the strong near-field light from the through hole AA14 of the antenna layer AA6. The wavelength of the output near-field light is in the range of 200 nm to 930 nm and is the wavelength that can be absorbed by the well-known photoelectric conversion layer AA4 made of such a material as the p-type GaAs semiconductor.

The near-field light is outputted in the direction from the second principal surface AA6*b* toward the first principal surface AA6*a* of the antenna layer AA6 and is received by the photoelectric conversion layer AA4. The region around the through hole AA14 in the photoelectric conversion layer AA4 receives the near-field light and generates photoelectrons ($e^-$) in an amount according to the intensity of the near-field light (quantity of received light). The photoelectrons ($e^-$) generated in the region around the through hole AA14 in the photoelectric conversion layer AA4 are outputted through the active layer AA16 from the through hole AA14 toward the focusing electrode AA64. The intensity of the near-field light is proportional to and greater than the intensity of the light of the wavelength λ included in the incident light (hv). Therefore, the region around the through hole AA14 in the photoelectric conversion layer AA4 generates a sufficient amount of photoelectrons ($e^-$), so that a sufficient amount of photoelectrons ($e^-$) are outputted through the through hole AA14 of the antenna layer AA6.

The photoelectrons ($e^-$) outputted from the photocathode AA1 are drawn out and focused by the focusing electrode AA64 and pass through the aperture AA64*a* of the focusing electrode AA64. The plurality of dynodes AA66, receiving the photoelectrons ($e^-$) having passed through the aperture AA64*a*, generate secondary electrons and multiply the generated secondary electrons. The multiplied secondary electrons are led to the final dynode AA68 and further multiplied by the final dynode AA68. Since the bias voltage AA-Vb is applied between the anode electrode AA70 and the cathode electrode AA72, the secondary electrons after multiplied by the final dynode AA68 are collected by the anode electrode AA70 and outputted through the unrepresented stem pin connected to the anode electrode AA70, to the outside of the photomultiplier tube AA60.

As described above, the photomultiplier tube AA60 of the first embodiment has the photocathode AA1 of the aforementioned embodiment. The photocathode AA1 has the antenna layer AA6 to induce the surface plasmon resonance. For this reason, the photocathode AA1 is able to output a sufficient amount of photoelectrons ($e^-$) according to incidence of the light of the specific wavelength. In the photomultiplier tube AA60, photoelectrons ($e^-$) are outputted only through the through hole AA14 of the photocathode AA1. Likewise, for example, the thermal electrons generated by heat or the like independent of the incident light are also outputted only through the through holes AA14. For this reason, the dark current to become noise is much smaller than that in the case without the antenna layer AA6. Therefore, the present invention provides the photomultiplier tube AA60 having an excellent detection sensitivity for the light of the specific wavelength and permitting easy manufacture.

The present invention is not limited to the above embodiment but may be modified in many ways. For example, the photomultiplier tube AA60 used the photocathode AA1 as a transmission type photocathode, which outputs the photoelectrons ($e^-$) from the surface opposite to the entrance surface of the incident light (hv), but the photocathode AA1 may be used as a reflection type photocathode which outputs the photoelectrons ($e^-$) from the entrance surface of the incident light (hv).

(Electron Bombardment Type Photomultiplier Tube)

Figure 12:
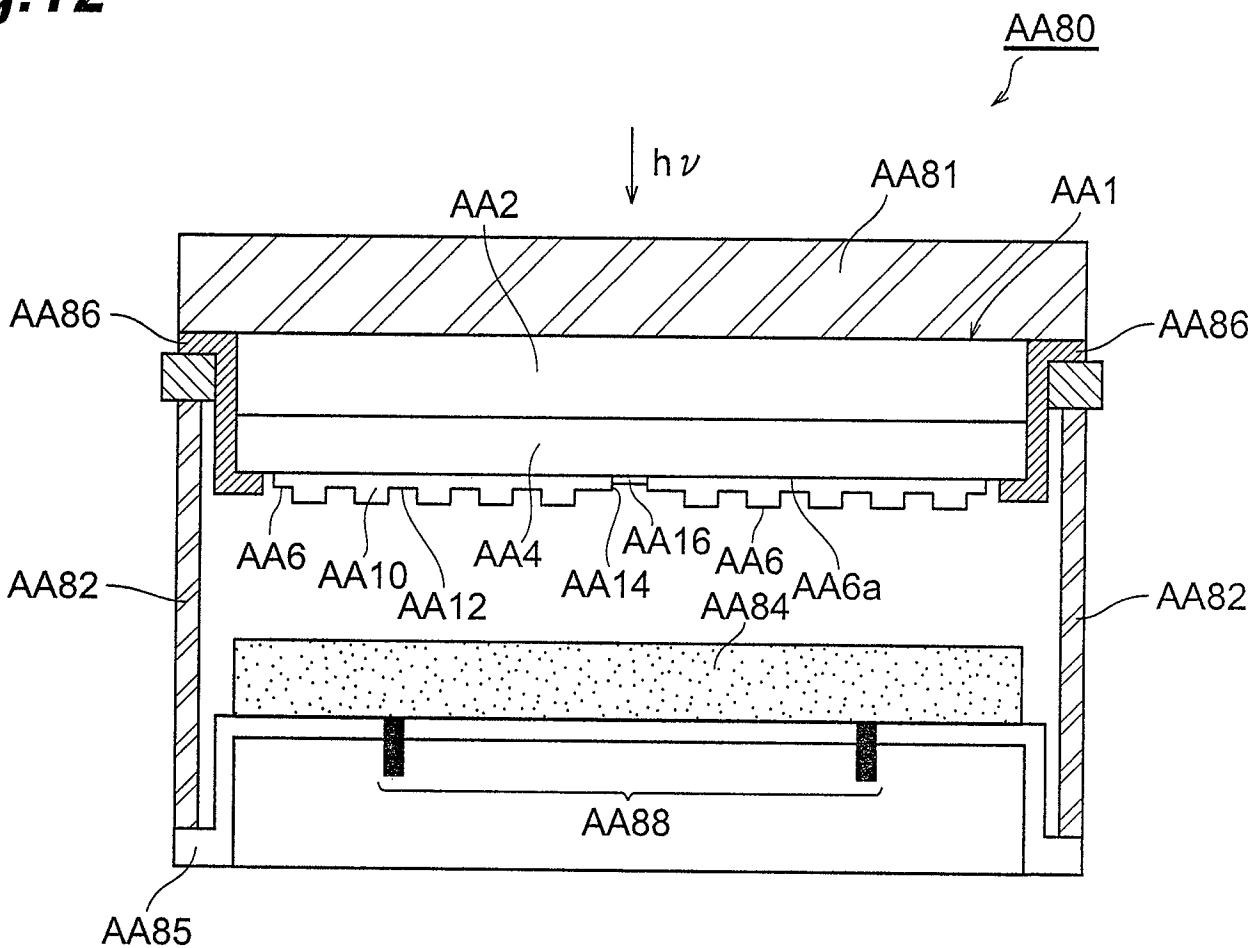
FIG. 12 is a sectional schematic view of an electron bombardment type photomultiplier tube according to the first embodiment of the present invention.

An electron bombardment type photomultiplier tube will be described below. FIG. 12 is a sectional schematic view of a photomultiplier tube AA80. The photomultiplier tube AA80 has a glass face plate AA81, the photocathode AA1, a vacuum container AA82, and a photodiode AA84.

The glass face plate AA81 is supported at one end of the vacuum container AA82 and a bottom plate AA85 is supported at the other end of the vacuum container AA82. The glass face plate AA81 and the bottom plate AA85 airtightly seal the vacuum container AA82 to keep the interior of the vacuum container AA82 in vacuum. Inside the vacuum container AA82, the photocathode AA1 and the photodiode AA84 are disposed in order from the glass face plate AA81 side. The photocathode AA1 is mounted at one end inside the vacuum container AA82 so that the support substrate AA2 is located on the glass face plate AA81 side and that the antenna layer AA6 is located on the photodiode AA84 side. An electrode AA86 is connected to the periphery of the photoelectric conversion layer AA4 in the photocathode AA1. The photodiode AA84 with multiplication action upon bombardment of photoelectrons is installed opposite to the photocathode AA1 on the upper surface of the bottom plate AA85. Stem pins AA88 are connected to the photodiode AA84 and one ends of the stem pins extend through the bottom plate AA85.

A reverse bias voltage is applied through the stem pins AA88 to the photodiode AA84. A voltage of several kV is applied between the photocathode AA1 and the photodiode AA84 through the stem pins AA88 and the electrode AA86.

The following will describe the operation of the photomultiplier tube AA80 having the configuration as described above. When light (hv) is incident to the glass face plate AA81 as an entrance window of the photomultiplier tube AA80, the incident light (hv) travels through the glass face plate AA81 to reach the photocathode AA1. The photocathode AA1 operates in the same manner as the photocathode AA1 in the line focus type photomultiplier tube AA60 does. Specifically, the antenna layer AA6 of the photocathode AA1 induces the surface plasmon resonance with the light of the wavelength λ included in the incident light (hv). Then the near-field light of the wavelength in the range of 200 nm to 930 nm is outputted from the through hole AA14. The region around the through hole AA14 in the photoelectric conversion layer AA4 receives the near-field light to generate photoelectrons ($e^-$) in an amount according to the intensity of the near-field light (quantity of received light). The photoelectrons ($e^-$) generated in the region around the through hole AA14 in the photoelectric conversion layer AA4 are outputted through the active layer AA16 from the through hole AA14 into vacuum. Since the intensity of the near-field light is proportional to and greater than the intensity of the light of the wavelength λ included in the incident light (hv), a sufficient amount of photoelectrons ($e^-$) are outputted through the through hole AA14 of the antenna layer AA6.

The photoelectrons ($e^-$) outputted into vacuum, while being accelerated by the voltage applied between the photocathode AA1 and the photodiode AA84, impinge upon the photodiode AA84. The photodiode AA84, receiving the photoelectrons ($e^-$), generates secondary electrons at a multiplication ratio of several thousand secondary electrons per incident photoelectron ($e^-$). The multiplied secondary electrons are outputted through the stem pins AA88 to the outside of the photomultiplier tube AA80.

As described above, the photomultiplier tube AA80 of the first embodiment has the photocathode AA1 of the aforementioned embodiment. The photocathode AA1 has the antenna layer AA6 to induce the surface plasmon resonance. For this reason, the photocathode AA1 is able to output a sufficient amount of photoelectrons ($e^-$) according to incidence of the light of the specific wavelength. In the photomultiplier tube AA80, the photoelectrons ($e^-$) are outputted only through the through hole AA14 of the photocathode AA1. Likewise, for example, the thermal electrons generated by heat or the like independent of the incident light are also outputted only through the through holes AA14. For this reason, the dark current to become noise is much smaller than that in the case without the antenna layer AA6. Therefore, the present invention provides the photomultiplier tube AA80 having an excellent detection sensitivity for the light of the specific wavelength and permitting easy manufacture.

The present invention is not limited to the above embodiment but may be modified in many ways. For example, the photomultiplier tube AA80 used the photocathode AA1 as a transmission type photocathode, which outputs the photoelectrons ($e^-$) from the surface opposite to the entrance surface of the incident light (hv), but the photocathode AA1 may be used as a reflection type photocathode which outputs the photoelectrons ($e^-$) from the entrance surface of the incident light (hv). Furthermore, the photoelectrons ($e^-$) were made incident to the photodiode AA84 in the photomultiplier tube AA80, but a charge coupled device (CCD) may also be used instead of the photodiode AA84.

Second Embodiment (Field Assist Type Photocathode)

Figure 13:
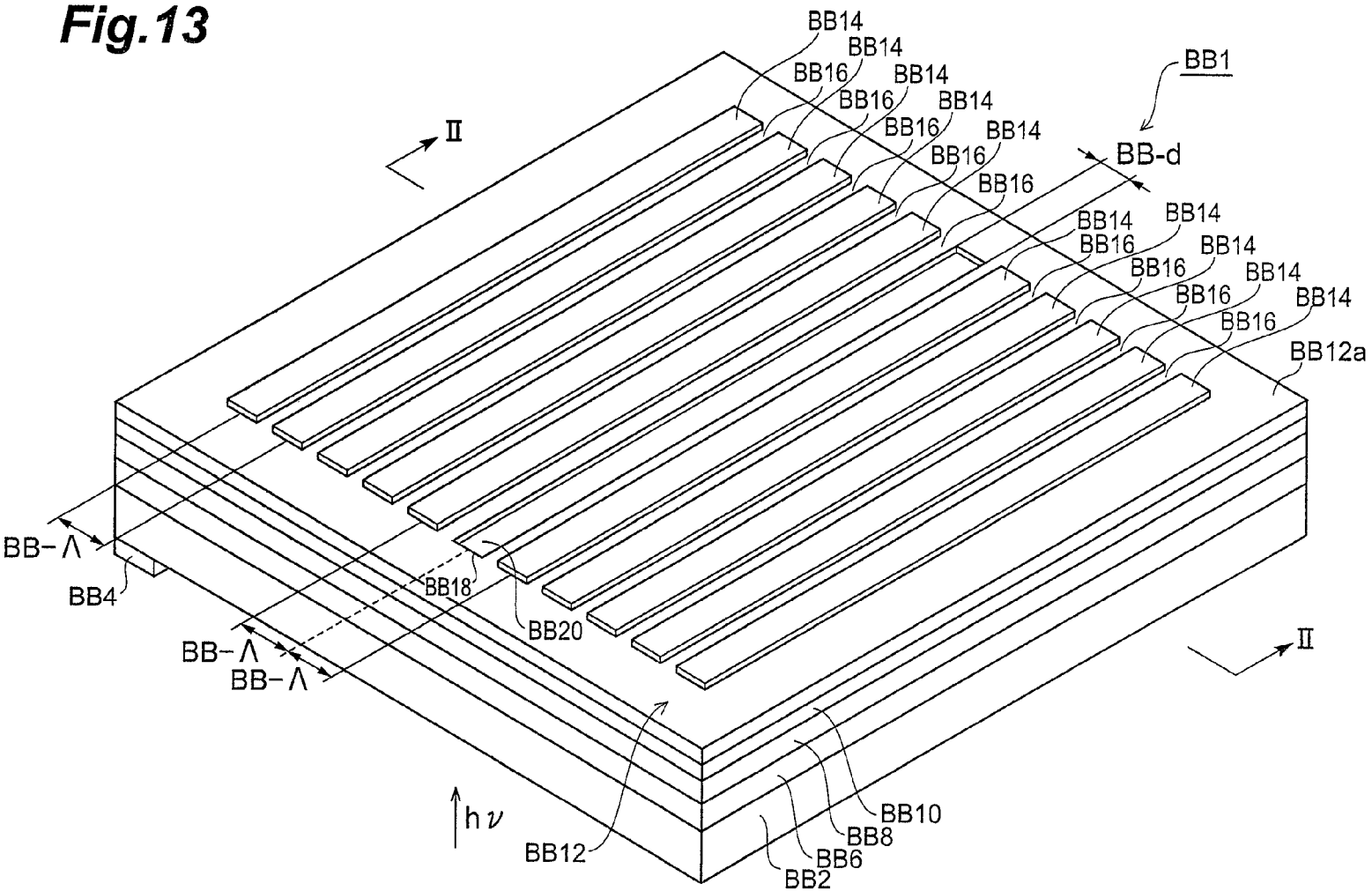
FIG. 13 is a plan view showing a configuration of an embodiment of the field assist type photocathode according to the present invention.
Figure 14:
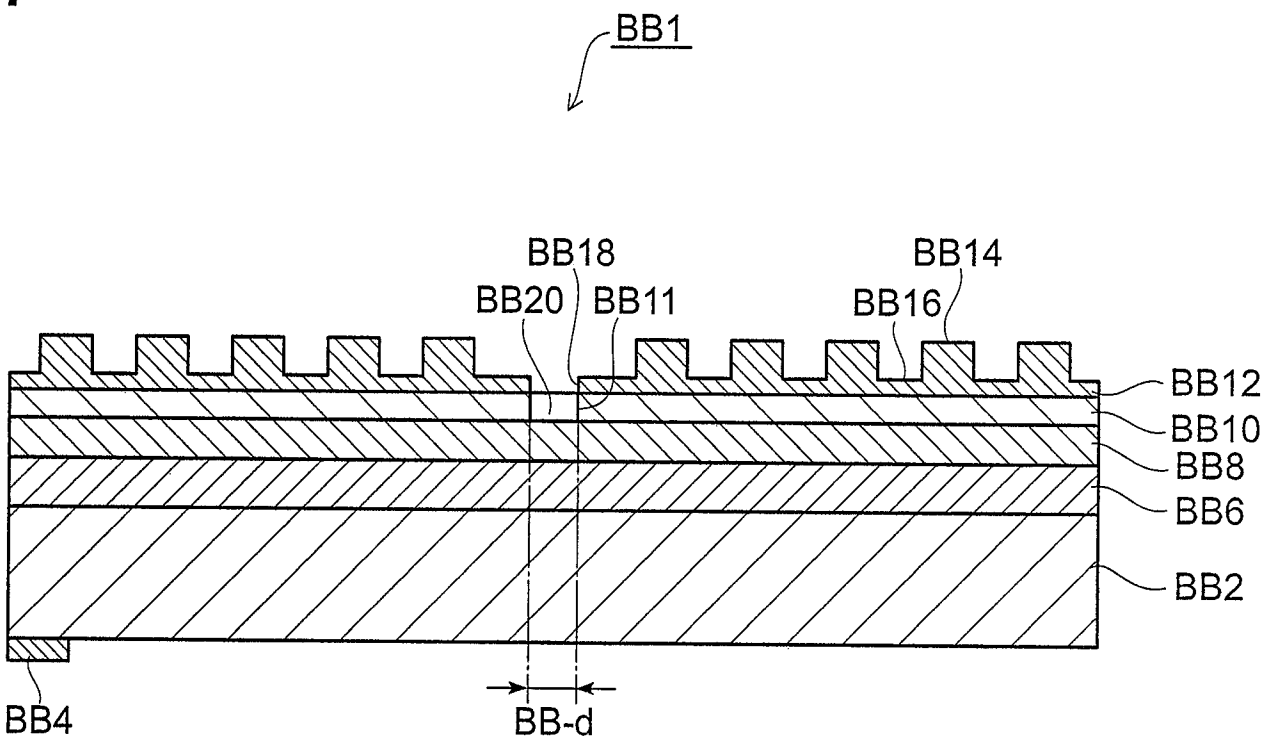
FIG. 14 is a sectional view along line II-II of the field assist type photocathode shown in FIG. 13.

FIG. 13 is a perspective view showing a configuration of an embodiment of the field assist type photocathode according to the present invention. FIG. 14 is a sectional view along line II-II of the field assist type photocathode shown in FIG. 13. The field assist type photocathode BB1 according to the second embodiment is a field assist type photocathode, as shown in FIG. 13, which has a support substrate BB2, a light absorbing layer BB6 laid on the support substrate BB2, an electron emitting layer BB8 laid on the light absorbing layer BB6, a contact layer BB10 laid on the electron emitting layer BB8, a first electrode BB12 laid on the contact layer BB10, and a second electrode BB4.

The support substrate BB2 is a semiconductor substrate and is made, for example, of a p-type InP semiconductor. The support substrate BB2 has a first principal surface to which incident light (hv) is incident, and a second principal surface opposed to the first principal surface. The second electrode BB4 is formed on the first principal surface of the support substrate BB2 and the light absorbing layer BB6 is formed on the second principal surface.

The second electrode BB4 is made of a material that makes a good electric contact with the support substrate BB2, e.g., an electroconductive layer consisting of a stack of AuGe/Ni. The material of the second electrode BB4 is not limited to AuGe/Ni but may be any material that makes a good electric contact with the support substrate BB2. Therefore, it may be, for example, Au/Ge, Ti/Pt/Au, Ag/ZnTi, or the like.

The light absorbing layer BB6 is a portion to effect photoelectric conversion, and absorbs light to generate photoelectrons. The light absorbing layer BB6 is made, for example, of a p-type InGaAs semiconductor. The electron emitting layer BB8 formed on the light absorbing layer BB6 is a portion that accelerates the photoelectrons generated in the light absorbing layer BB6. The electron emitting layer BB8 is made, for example, of a p-type InP semiconductor. The light absorbing layer BB6 and electron emitting layer BB8 are of a nearly planar shape.

When the field assist type photocathode BB1 is viewed from the stack direction (the direction normal to the principal surfaces of the light absorbing layer BB6), an active layer BB20 is formed inside a through hole BB18 of the first electrode BB12. More specifically, as shown in FIG. 14, a part of a surface of the electron emitting layer BB8 is exposed through a through hole BB11 of the contact layer BB10 described below and through the through hole BB18 of the first electrode BB12. The active layer BB20, which is formed as a very thin and uniform layer, is formed on the portion exposed through the through holes BB11, BB18. The active layer BB20 is made, for example, of an alkali metal such as Cs. This active layer BB20 lowers the work function of the surface of the electron emitting layer BB8. For this reason, it becomes easy to output the photoelectrons generated in the electron emitting layer BB8, through the through holes BB11, BB18 into vacuum. The material of the active layer BB20 is not always limited to Cs, but the alkali metal may be K, Rb, or Na as well as Cs. The material of the active layer BB20 may also be an oxide of any one of the alkali metals as listed above, or a fluoride of any one of the alkali metals as listed above.

The contact layer BB10 is formed on the electron emitting layer BB8. The contact layer BB10 is a portion that forms a pn junction with the electron emitting layer BB8 and is made, for example, of an n-type InP semiconductor. The through hole BB11 penetrating in the thickness direction is formed in the contact layer BB10. The through hole BB11 in the present invention is not always limited to a physical hole but may also be an optical hole (opening that transmits light).

The first electrode BB12 is formed on the contact layer BB10. The first electrode BB12 is electrically connected to the contact layer BB10. The first electrode BB12, together with the second electrode BB4, applies a voltage between the first principal surface and the second principal surface of the light absorbing layer BB6. More specifically, a bias voltage is applied between the first electrode BB12 and the second electrode BB4. The first electrode BB12 contains an electroconductive material. The contained electroconductive material is preferably Al, Ag, Au, or the like, but may be any other material as long as it makes a good electric contact with the contact layer BB10.

The through hole BB18 penetrating in the thickness direction is provided in the central region of the first electrode BB12. The through hole BB18 is of a nearly rectangular shape consisting of longer and shorter sides and is in communication with the through hole BB11 of the contact layer BB10. The length of the shorter sides of the through hole BB18 (minimum width), BB-d, is shorter than the wavelength of the light incident through the support substrate BB2, the light absorbing layer BB6, the electron emitting layer BB8, and the contact layer BB10 into the first electrode BB12. When the length BB-d of the shorter sides of the through hole BB18 is defined in this manner, it is feasible to surely output only near-field light (which will be detailed later) from the through hole BB18. The through hole BB18 in the present invention is not limited to a physical hole, but may also be an optical hole (opening that transmits light). In the second embodiment, the through hole BB11 and the through hole BB18 have the same size.

The first electrode BB12 has a first principal surface joined to the contact layer BB10, and a second principal surface BB12*a* opposed to the first principal surface. A plurality of projections BB14 and a recess BB16 located between the projections BB14 are formed in the second principal surface BB12*a* of the first electrode BB12. The aforementioned through hole BB18 is located in the recess BB16. The plurality of projections BB14 are of a nearly rectangular shape consisting of longer and shorter sides as the through hole BB18 is. The plurality of projections BB14 are one-dimensionally arranged with their longer sides being opposed to each other, and are arranged in symmetry with respect to the through hole BB18. The center distance between projections BB14 adjacent to each other without intervention of the through hole BB18 is BB-Λ, and the center distance between projections BB14 adjacent to each other with the through hole BB18 in between is double BB-Λ. This distance BB-Λ will be referred to hereinafter as a periodic interval. The projections BB14 arranged in this manner and the recess BB16 located between the projections BB14 form a pattern according to a predetermined period in the second principal surface BB12*a* of the first electrode BB12. The first electrode with the pattern in the surface is able to output the near-field light with the intensity greater than in the case of a flat first electrode without the projections and recess in the surface.

The periodic interval BB-Λis properly set according to the wavelength of light to be detected. Let us consider a case in which light of a wavelength $\lambda_0$ (=2πc/ω) is normally incident to the first electrode BB12. In this case, if the periodic interval BB-Λ of the first electrode BB12 satisfies Formula (3) below, the surface plasmon resonance takes place with the light of the wavelength $\lambda_0$ in the first electrode BB12.

[Mathematical Formula 3]

$$BB-\Lambda = m\lambda_0\sqrt{\frac{\varepsilon_a+\varepsilon_{metal}}{\varepsilon_a\cdot\varepsilon_{metal}}} \quad (3)$$

In the equation, $\in_a$ is the relative dielectric constant of a dielectric in contact with the first electrode BB12 and in vacuum $\in_a=1$. Furthermore, $\in_{metal}$ is the relative dielectric constant of the first electrode BB12 and $\in_{metal}>0$. Therefore, we can derive Formula (4) below.

[Mathematical Formula 4]

$$BB\text{-}\Lambda<\lambda_0 \quad (4)$$

According to Formula (4), for inducing the surface plasmon resonance with the light of the wavelength $\lambda_0$, it is necessary to set the periodic interval BB-Λ in the first electrode BB12 shorter than the wavelength $\lambda_0$. It is seen from this fact that the length (width) BB-d of the shorter sides of the through hole BB18 also needs to be shorter than the wavelength $\lambda_0$.

FIG. 15 shows a relation between the periodic interval BB-Λ and the wavelength $\lambda_0$ of light in cases where m in Formula (3) is 1 and where the first electrode BB12 is made of Ag or Al. It is apparent from FIG. 15 that the periodic interval BB-Λ should be set at 1234 nm in the Ag case of the first electrode BB12 in order to induce the surface plasmon resonance with the light of the wavelength $\lambda_0$=1240 nm in the first electrode BB12. In the second embodiment, the periodic interval BB-Λ of the first electrode BB12 is so set that the surface plasmon resonance takes place with the light of the wavelength λ.

Incidentally, when the surface plasmon resonance takes place, the near-field light is outputted from the through hole BB18 of the first electrode BB12. It is conventionally known that the wavelength of the output near-field light is also dependent upon the periodic interval BB-Λ. In the second embodiment, the periodic interval BB-Λ of the first electrode BB12 is so set that the wavelength of the near-field light outputted from the through hole BB18 of the first electrode BB12 becomes a wavelength that can be absorbed in the light absorbing layer BB6. The wavelength of the near-field light outputted from the through hole BB18 of the first electrode BB12 will be referred to hereinafter as the wavelength $\lambda_y$.

Figure 16:
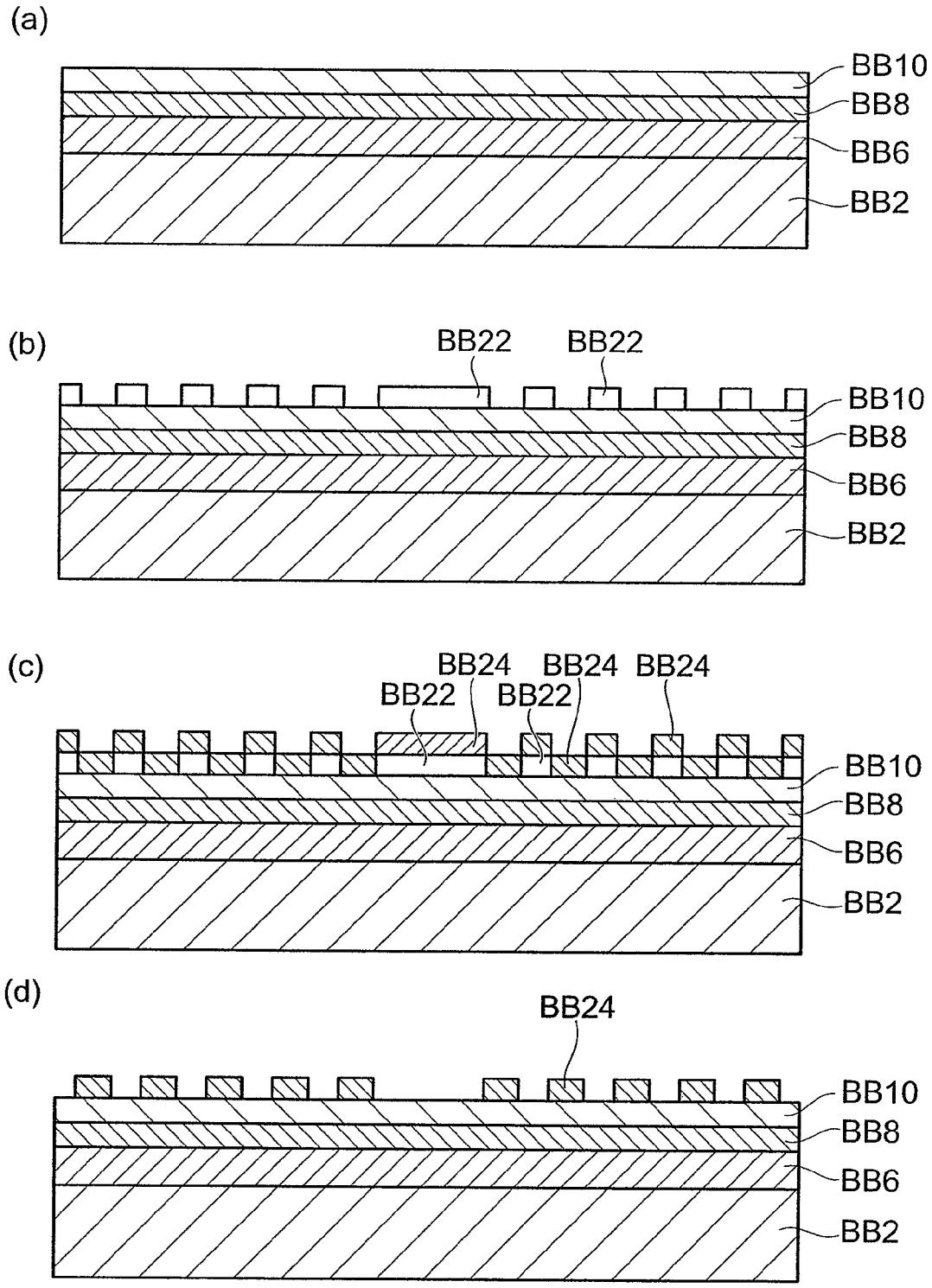
FIG. 16 is sectional views showing steps of manufacturing the field assist type photocathode according to the second embodiment.

Subsequently, steps of manufacturing the field assist type photocathode BB1 will be explained. The first step, as shown in FIG. 16 (*a*), is to prepare the support substrate BB2 made of a p-type InP semiconductor. The light absorbing layer BB6 of a p-type InGaAs semiconductor, the electron emitting layer BB8 of a p-type InP semiconductor, and the contact layer BB10 of an n-type InP semiconductor are then laid in this order on the prepared support substrate BB2. These layers can be formed, for example, by metal-organic vapor phase epitaxy (MOVPE), chloride vapor phase epitaxy (chloride VPE), hydride vapor phase epitaxy (hydride VPE), molecular beam epitaxy (MBE), liquid phase epitaxy (LPE), and so on.

The next step, as shown in FIG. 16 (*b*), is to apply a photoresist BB22 onto the contact layer BB10 and thereafter effect such patterning of the photoresist BB22 that openings are made in the regions where the projections BB14 are to be formed. The subsequent step, as shown in FIG. 16 (*c*), is to effect evaporation to deposit an electroconductive film BB24 containing Al, Ag, Au, or the like, on the contact layer BB10 masked by the photoresist BB22. The patterning of the photoresist BB22 may be implemented by photolithography with ultraviolet light or the like, or by electron beam lithography with an electron beam.

Figure 17:
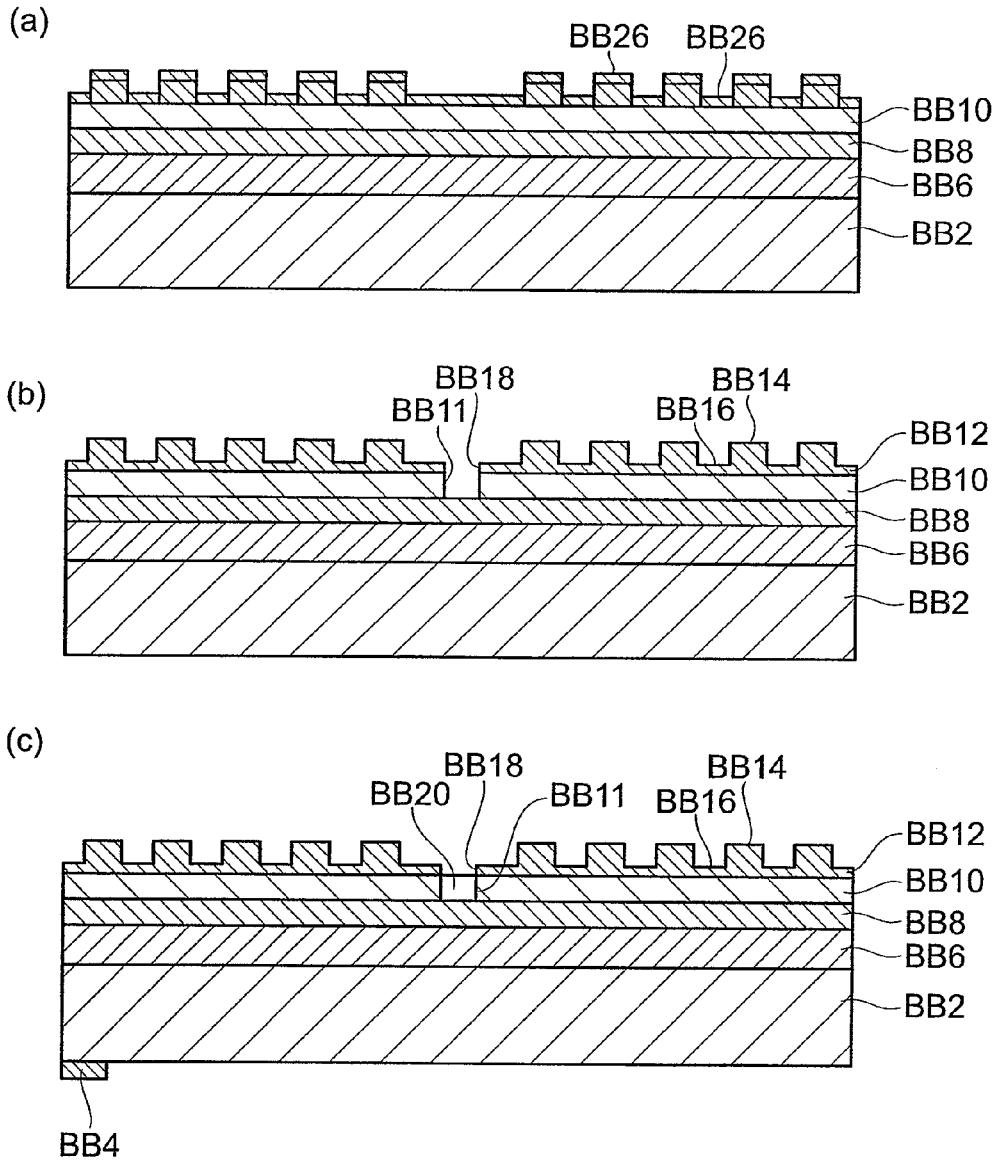
FIG. 17 is sectional views showing the steps subsequent to FIG. 16.

The next step, as shown in FIG. 16 (*d*), is to effect lift-off removal of portions of the electroconductive film BB24 deposited on the photoresist BB22, together with the photoresist BB22. After the lift-off removal, an electroconductive film BB26 of the same material as the electroconductive film BB24 is deposited by evaporation, as shown in FIG. 17 (*a*). After the deposition of the electroconductive film BB26, a portion thereof is irradiated with a focused ion beam (FIB) to form the through holes BB11, BB18, as shown in FIG. 17 (*b*).

The next step, as shown in FIG. 17 (*c*), is to form the active layer BB20 of such an alkali metal as Cs, on the portion exposed through the through hole BB18 of the light absorbing layer BB6. The second electrode BB4 of AuGe/Ni is formed on the first principal surface of the support substrate BB2. The field assist type photocathode BB1 shown in FIG. 13 is completed through the above steps.

Subsequently, the operation of the field assist type photocathode BB1 will be described. When light (hv) is incident from the first principal surface side of the support substrate BB2 as shown in FIG. 13, the incident light (hv) passes through the support substrate BB2, the light absorbing layer BB6, the electron emitting layer BB8, and the contact layer BB10 to reach the first electrode BB12. When the incident light (hv) reaches the surface with the pattern comprised of the projections BB14 and the recess BB16, i.e., the second principal surface BB12*a* of the first electrode BB12, light of the wavelength $\lambda_x$ included in the incident light (hv) couples with surface plasmons in the first electrode BB12. This results in inducing the surface plasmon resonance in the first electrode BB12.

When the surface plasmon resonance takes place, the first electrode BB12 outputs strong near-field light from the through hole BB18. A direction of output of the near-field light is a direction from the pattern-formed surface toward the surface without the pattern, i.e., a direction from the second principal surface BB12*a* to the first principal surface. The intensity of this near-field light outputted from the through hole BB18 is proportional to and greater than the intensity of the light of the wavelength $\lambda_x$ included in the incident light (hv). The wavelength $\lambda_y$ of the near-field light is dependent upon the periodic interval BB-Λ of the pattern formed in the surface of the first electrode BB12.

The near-field light outputted from the through hole BB18 of the first electrode BB12 travels through the through hole BB11 of the contact layer BB10 and the electron emitting layer BB8 to enter the light absorbing layer BB6. The wavelength of the near-field light is $\lambda_y$, which is the wavelength that can be absorbed in the light absorbing layer BB6. For this reason, the region around the through holes BB11, BB18 in the light absorbing layer BB6 absorbs the near-field light to generate photoelectrons in an amount according to the intensity of the near-field light (quantity of received light).

The near-field light outputted from the through hole BB18 of the first electrode BB12 has the very large intensity, for example, as compared with that of light outputted from a through hole of a first electrode when light (hv) is incident to the first electrode without the projections and the recess in its surface. For this reason, an amount of photoelectrons generated in the region around the through holes BB11, BB18 is much larger than an amount of photoelectrons generated in the case using the foregoing first electrode with the flat surface instead of the first electrode BB12.

The bias voltage is applied between the first electrode BB12 and the second electrode BB4. Since the pn junction is formed between the electron emitting layer BB8 and the contact layer BB10, the photoelectrons generated in the light absorbing layer BB6 are transported into the electron emitting layer BB8 by virtue of action of an electric field established by the bias voltage applied between the first and second electrodes BB12, BB4. At this time, among the photoelectrons generated in the light absorbing layer BB6, the photoelectrons generated in the region around the through holes BB11, BB18, i.e., the photoelectrons by the near-field light are transported into the region around the through holes BB11, BB18, in the electron emitting layer BB8. The photoelectrons transported into the region around the through holes BB11, BB18 are emitted through the through hole BB11 of the contact layer BB10 whose work function is lowered by the active layer BB20, and through the through hole BB18 of the first electrode BB12 to the outside in vacuum.

Incidentally, in addition to the photoelectrons by the near-field light, thermal electrons are also generated in the region around the through holes BB11, BB18 in the light absorbing layer BB6. The thermal electrons generated in the region around the through holes BB11, BB18 are transported into the region around the through holes BB11, BB18, in the electron emitting layer BB8 as the photoelectrons by the near-field light are, and then emitted through the through hole BB11 of the contact layer BB10 and the through hole BB18 of the first electrode BB12 to the outside in vacuum. An amount of the thermal electrons generated in the region around the through holes BB11, BB18 is much smaller than the total amount of thermal electrons generated in the entire light absorbing layer BB6. Particularly, in the second embodiment, the length BB-d of the shorter sides of the through hole BB18 is shorter than the wavelength of the light incident to the first electrode BB12, and thus the through hole BB18 is narrow. The amount of thermal electrons generated in the region around the narrow through holes BB11, BB18 is extremely smaller than the total amount of thermal electrons generated in the entire light absorbing layer BB6. For this reason, the amount of thermal electrons emitted to the outside is also extremely small. As described above, the amount of emitted photoelectrons is increased while the amount of emitted thermal electrons is decreased, in the field assist type photocathode BB1.

In the field assist type photocathode BB1 of the second embodiment, as described above, the pattern comprised of the projections BB14 and the recess BB16 is formed at the periodic interval BB-Λ in the second principal surface BB12*a* of the first electrode BB12. For this reason, the first electrode BB12 induces the surface plasmon resonance with the light of the wavelength $\lambda_x$ and outputs the near-field light of the wavelength $\lambda_y$ from the through hole BB18. The near-field light outputted from the through hole BB18 is incident to the light absorbing layer BB6. The light absorbing layer BB6 absorbs the near-field light to generate photoelectrons in an amount according to the intensity of the near-field light. The photoelectrons by the near-field light are generated in the region around the through hole BB18. For this reason, the photoelectrons generated in the region around the through hole BB18, i.e., the photoelectrons by the near-field light are outputted through the through hole BB18. The intensity of the near-field light is proportional to and greater than the intensity of the light of the wavelength $\lambda_x$ included in the incident light (hv). Therefore, a sufficient amount of photoelectrons are generated in the region around the through hole BB18 in the light absorbing layer BB6, so that a sufficient amount of photoelectrons are outputted through the through hole BB18 of the first electrode BB12.

The light absorbing layer BB6 generates thermal electrons as well as photoelectrons, in the region located around the through hole BB18. The thermal electrons generated in the region around the through hole BB18 are also emitted through the through hole BB18 to the outside as the photoelectrons are. The amount of thermal electrons generated in the region around the through hole BB18 is extremely smaller than the total amount of thermal electrons generated in the entire light absorbing layer BB6. Therefore, the amount of thermal electrons emitted through the through hole BB18 is also very small. As a result, the amount of emitted photoelectrons is increased while the amount of emitted thermal electrons is decreased, in the field assist type photocathode BB1; it is thus feasible to reduce the noise due to the thermal electrons. It is then feasible to improve S/N ratios and to detect the light with an excellent sensitivity. Since the noise due to thermal electrons can be reduced by simply forming the through hole BB18, projections BB14, and recess BB16 in the first electrode BB12 in the field assist type photocathode BB1 of the second embodiment, there is no need for provision of a separate cooing means or the like. Accordingly, miniaturization can be achieved for a device incorporating the field assist type photocathode BB1.

In the field assist type photocathode BB1 of the second embodiment, the periodic interval BB-Λ of the first electrode BB12 is so set as to induce the surface plasmon resonance with the light of the wavelength $\lambda_x$. Therefore, the wavelength of the light to induce the surface plasmon resonance can be varied by changing the periodic interval BB-Λ. Namely, the wavelength of detectable light can be varied by simply changing the periodic interval BB-Λ of the first electrode BB12, i.e., by changing the pattern in the surface of the first electrode BB12. There is thus no need for provision of a filter or the like for changing the wavelength of detectable light, which facilitates the manufacture of the field assist type photocathode BB1.

The field assist type photocathode BB1 of the second embodiment was described using the example of the so-called transmission type photocathode, which emits the photoelectrons from the side opposite to the entrance side of the incident light, but it is needless to mention that the present invention, without having to be limited to it, is also applicable to the so-called reflection type photocathode which emits the photoelectrons from the same side as the entrance side of the incident light.

The present invention is not limited to the above embodiment, but may be modified in many ways. For example, in the second embodiment the light absorbing layer BB6 was made of the p-type InGaAs semiconductor, the electron emitting layer BB8 of the p-type InP semiconductor, and the contact layer BB10 of the n-type InP semiconductor. The materials of the light absorbing layer BB6, the electron emitting layer BB8, and the contact layer BB10 are not limited to these, but may be other semiconductors. By changing the materials of the light absorbing layer BB6, the electron emitting layer BB8, and the contact layer BB10, it is feasible to vary the wavelength of the light to be absorbed in the light absorbing layer BB6. It is possible to optionally use, for example, the materials as disclosed in U.S. Pat. No. 3,948,143, for the light absorbing layer BB6, the electron emitting layer BB8, and the contact layer BB10.

In the second embodiment the support substrate BB2 was made of the p-type InP semiconductor, but the material of the support substrate BB2, without having to be limited to it, may be another semiconductor material. It may be a transparent material to the incident light (hv) in the ultraviolet or visible region, e.g., glass, quartz, or sapphire.

Figure 18:
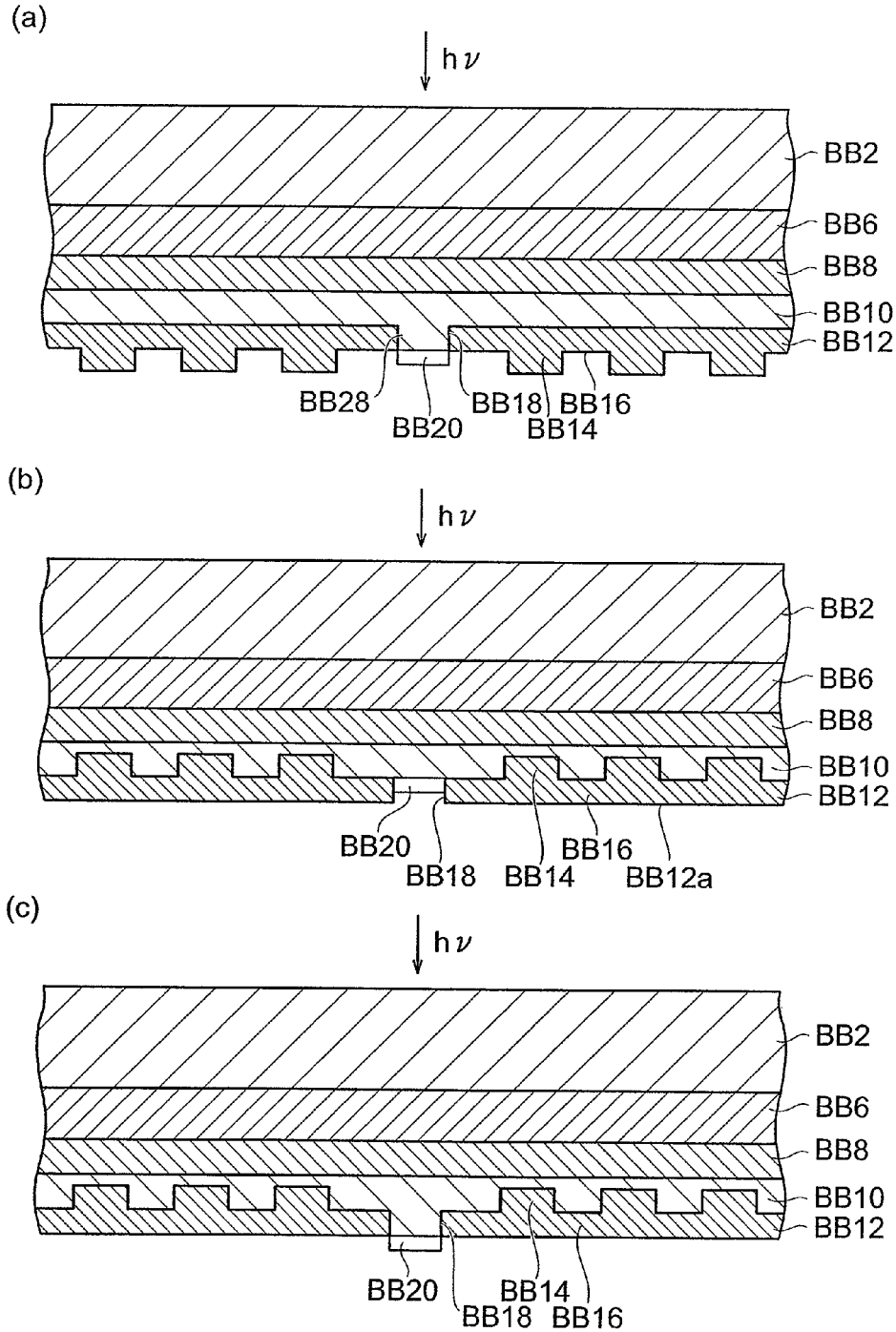
FIG. 18 is a drawing showing modification examples of the contact layer and the first electrode in the field assist type photocathode according to the second embodiment.

In the second embodiment the contact layer BB10 had the through hole BB11. This may be modified, as shown in FIG. 18 (*a*), so that the contact layer BB10 has a mesa portion BB28 at the position opposite to the through hole BB18 of the first electrode BB12. In the second embodiment, the projections BB14 and the recess BB16 were formed in the second principal surface BB12*a* of the first electrode BB12. This may be modified, as shown in FIG. 18 (*b*), so that the projections BB14 and the recess BB16 are formed in the first principal surface of the first electrode BB12. In the configuration where the projections BB14 and the recess BB16 are formed in the first principal surface of the first electrode BB12, the contact layer BB10 may be formed, as shown in FIG. 18 (*c*), so as to fill the through hole BB18 of the first electrode BB12. Furthermore, a Bragg reflecting layer may be formed around the first electrode BB12.

Figure 19:
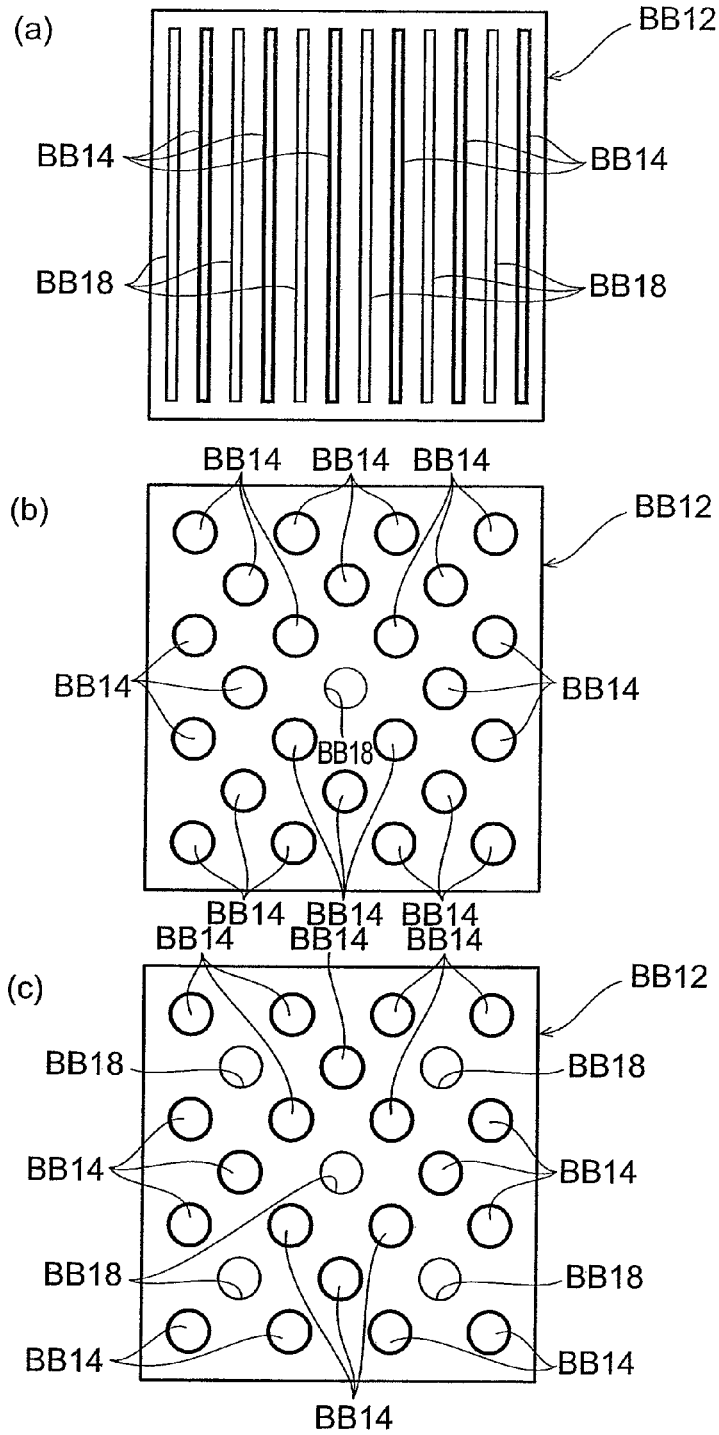
FIG. 19 is a drawing showing modification examples of the first electrode in the field assist type photocathode according to the second embodiment.
Figure 20:
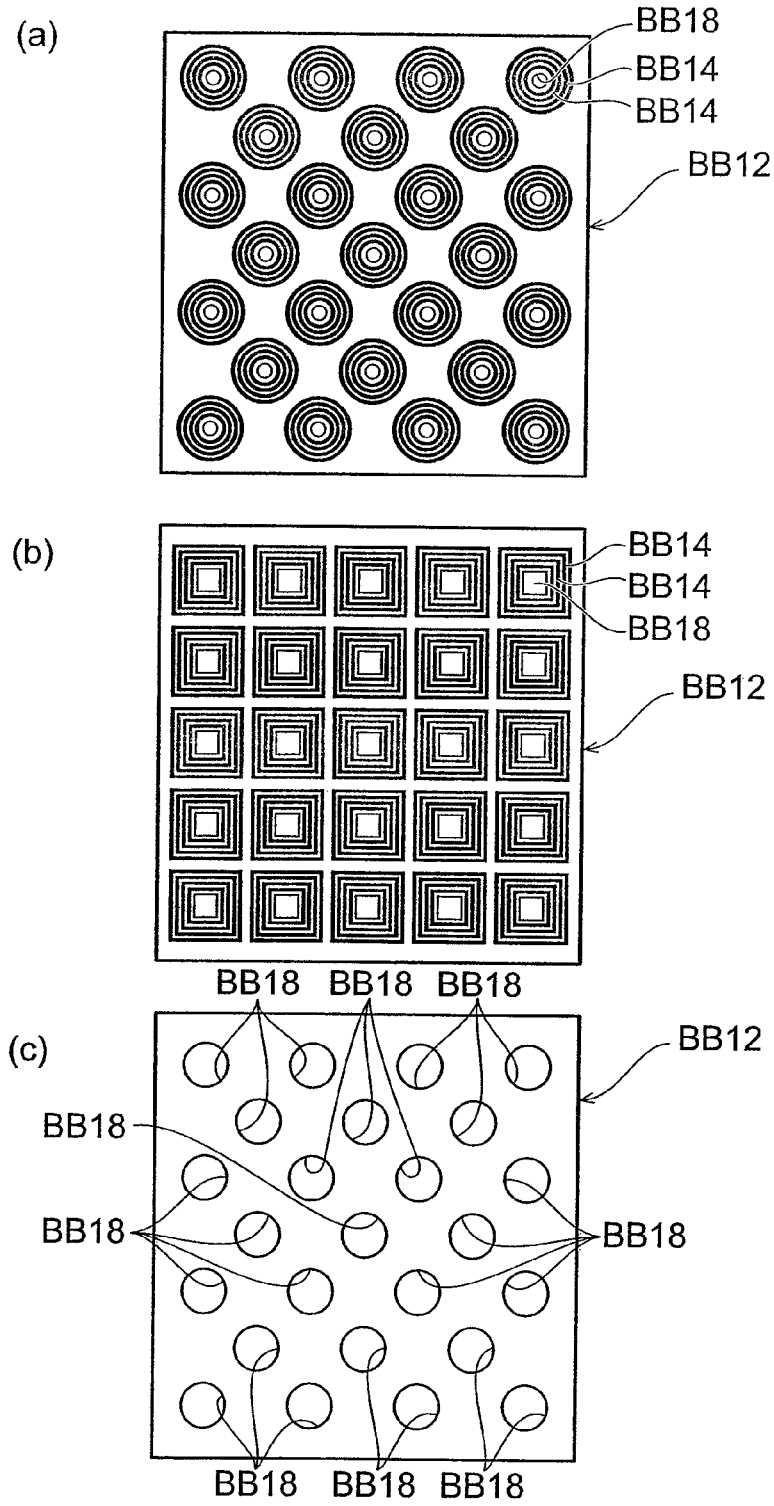
FIG. 20 is a drawing showing other modification examples of the first electrode in the field assist type photocathode according to the second embodiment.

The pattern in the surface of the first electrode BB12 is not always limited to that in the second embodiment. For example, as shown in FIG. 19 (*a*), it may be a pattern formed by one-dimensionally arranging projections BB14 of a nearly rectangular shape at even intervals and providing through holes BB18 of a nearly rectangular shape in respective recesses BB16 located between the projections BB14. It may also be a pattern, as shown in FIG. 19 (*b*), formed by locating a through hole BB18 of a nearly circular shape in the center and two-dimensionally arranging projections BB14 of a nearly circular shape at even intervals around the through hole BB18, or a pattern, as shown in FIG. 19 (*c*), formed by two-dimensionally arranging through holes BB18 of a nearly circular shape and projections BB14 of a nearly circular shape in an alternate manner and at even intervals. The diameter (minimum width) of the through holes BB18 of the nearly circular shape should be shorter than the wavelength of the light incident to the first electrode BB12. The pattern may also be one, as shown in FIG. 20 (*a*), formed by two-dimensionally arranging darts marks (also called bull's eyes), each mark consisting of a through hole BB18 and a plurality of projections BB14, at predetermined intervals. FIG. 20 (*b*) shows a modification of the pattern of FIG. 20 (*a*) into a rectangular shape.

In the field assist type photocathode BB1 of the second embodiment, the pattern in the surface of the first electrode BB12 was formed by the plurality of projections BB14 and the recess BB16 located between the projections BB14. It may be modified so that the pattern in the surface of the first electrode BB12 is formed by a plurality of through holes BB18. When the pattern in the surface of the first electrode BB12 is formed by two-dimensionally arranging the through holes BB18 at even intervals (predetermined intervals) as shown in FIG. 20 (*c*), the shape of the pattern in the first electrode BB12 can be modified by varying the locations and arrangement intervals of the through holes BB18.

Figure 21:
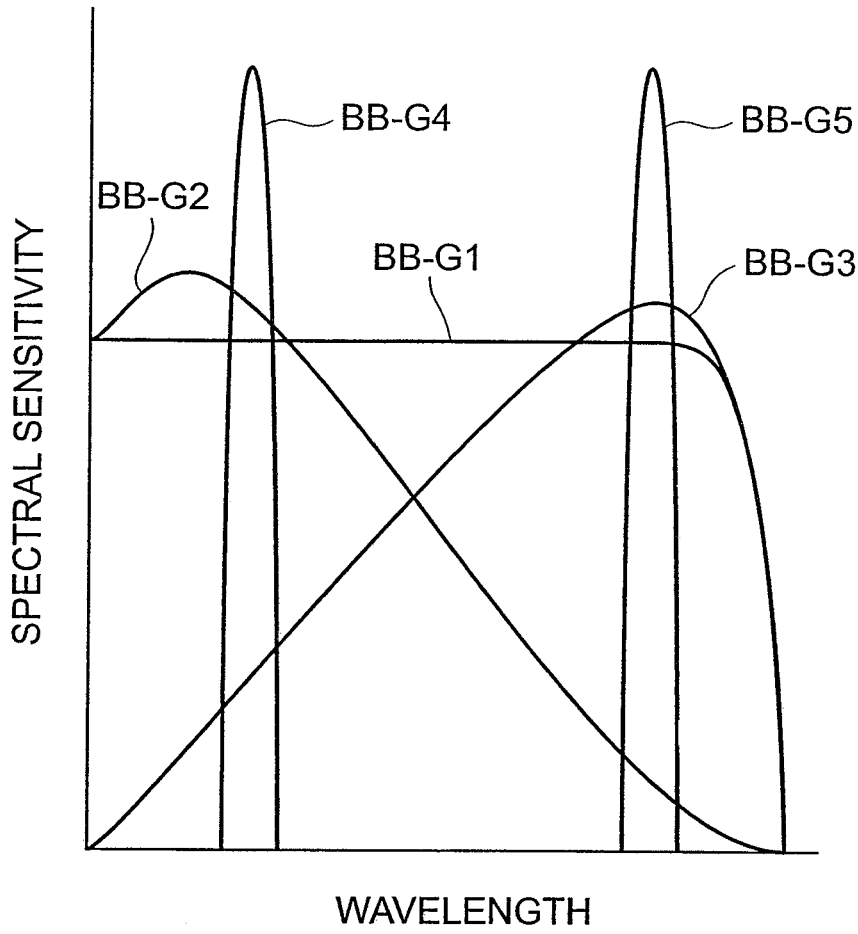
FIG. 21 is a graph showing spectral sensitivity characteristics of field assist type photocathodes with different patterns of the first electrode in the field assist type photocathodes according to the second embodiment.

By properly changing the shape of the pattern in the first electrode BB12 as described above, we can obtain various field assist type photocathodes as follows: a field assist type photocathode with a relatively wide sensitivity wavelength range and flat sensitivities, as indicated by curve BB-G1 in FIG. 21; a field assist type photocathode with a relatively wide sensitivity wavelength range and high spectral sensitivities on the short wavelength side, as indicated by curve BB-G2; a field assist type photocathode with a relatively wide sensitivity wavelength range and high spectral sensitivities on the long wavelength side, as indicated by curve BB-G3; a field assist type photocathode with a spectral sensitivity only at a specific wavelength on the short wavelength side, as indicated by curve BB-G4; a field assist type photocathode with a spectral sensitivity only at a specific wavelength on the long wavelength side, as indicated by curve BB-G5.

Figure 22:
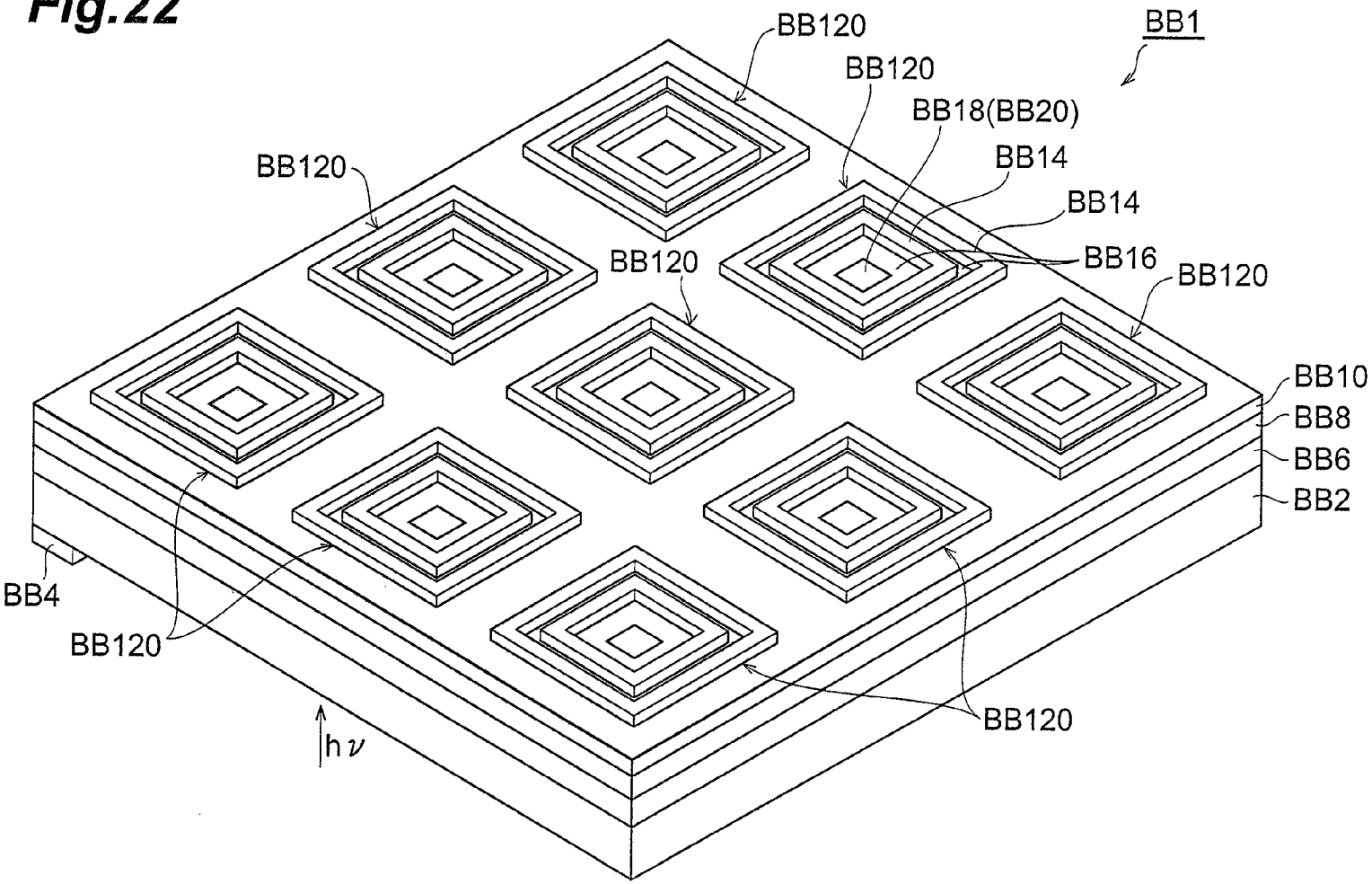
FIG. 22 is a drawing showing a modification example of the field assist type photocathode according to the second embodiment.

Another field assist type photocathode may be provided with a plurality of first electrodes BB120 of the same shape, as shown in FIG. 22. Furthermore, when it is arranged to be able to individually apply the voltage to each of the first electrodes BB120, it becomes feasible to apply the bias voltage between all the first electrodes BB120 and the second electrode BB4, or to apply the bias voltage between some of the first electrodes BB120 and the second electrode BB4. The photoelectrons are outputted through the through holes BB18 of the first electrodes BB120 to which the voltage is applied. For this reason, the light detection sensitivity can be varied by changing the number of first electrodes BB120 to which the voltage is applied, and piling up amounts of photoelectrons emitted through the through holes of the respective first electrodes BB120.

Figure 23:
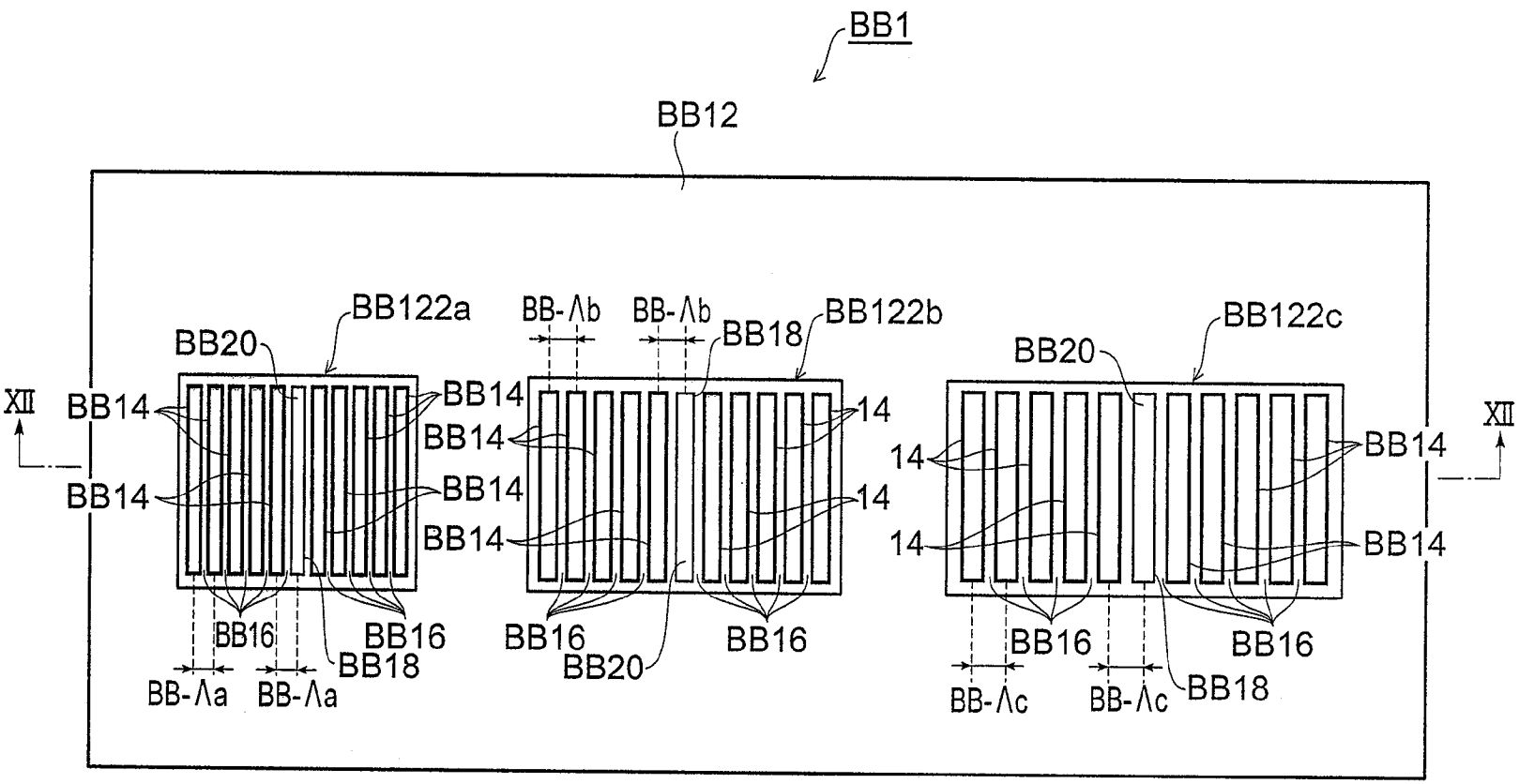
FIG. 23 is a drawing showing another modification example of the field assist type photocathode according to the second embodiment.
Figure 24:
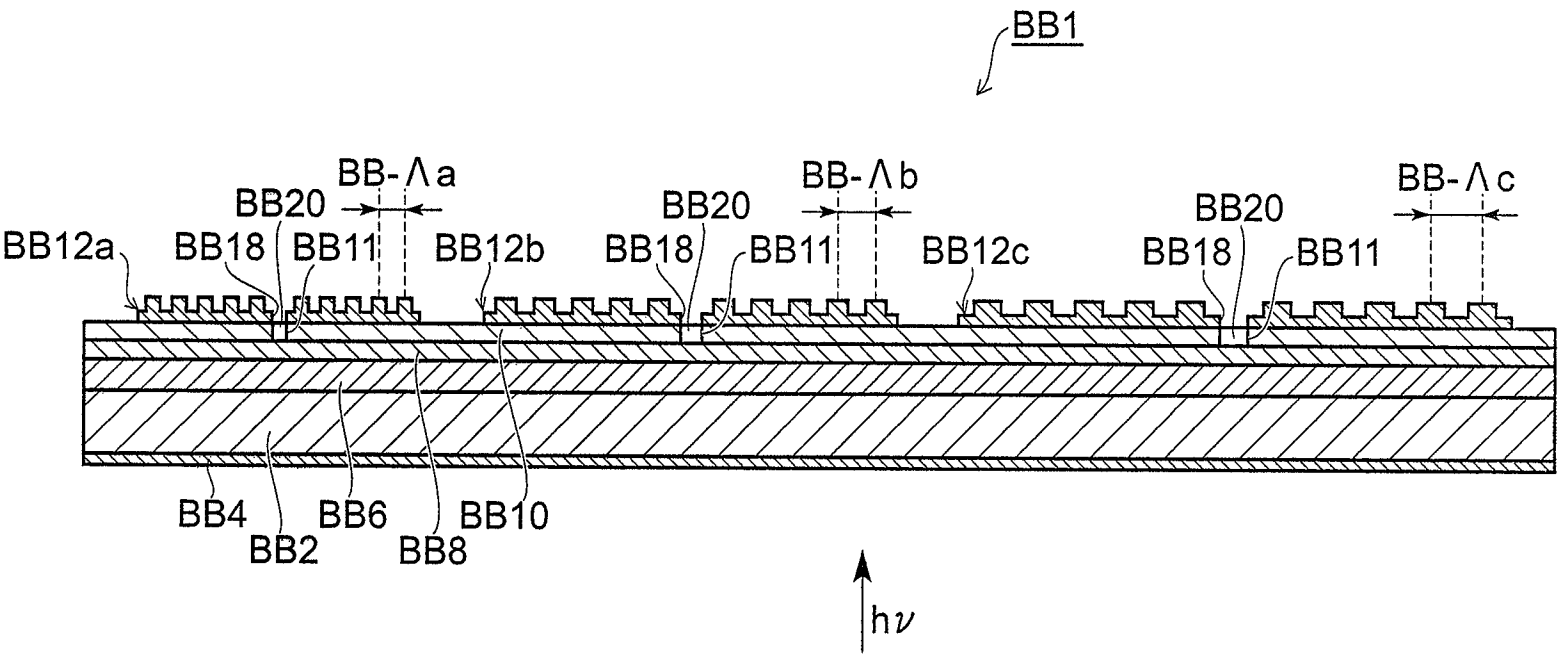
FIG. 24 is a sectional view along line XII-XII of the field assist type photocathode shown in FIG. 23.

Another field assist type photocathode, as shown in FIG. 23, has a plurality of first electrodes BB122*a*, BB122*b*, and BB122*c* with different patterns therein. FIG. 24 is a sectional view along line XII-XII of the field assist type photocathode BB1 shown in FIG. 23. In FIGS. 23 and 24, the periodic interval of the first electrode BB122*a* is BB-Λa, the periodic interval of the first electrode BB122*b* is BB-Λb, and the periodic interval of the first electrode BB122*c* is BB-Λc. The periodic intervals BB-Λa, BB-Λb, and BB-Λc are different from each other. Therefore, the wavelengths of light to induce plasmon resonance and beams of the output near-field light are also different from each other among the first electrodes BB122*a*, BB122*b*, and BB122*c*.

When the field assist type photocathode is arranged to be able to individually apply the voltage to each of the first electrodes BB122*a*, BB122*b*, and BB122*c* in the configuration, it becomes feasible to apply the bias voltage between all of the first electrodes BB122*a*, BB122*b*, BB122*c* and the second electrode BB4, or to apply the bias voltage between only the first electrode BB122*a* and the second electrode BB4. For example, when the bias voltage is applied between all of the first electrodes BB122*a*, BB122*b*, BB122*c* and the second electrode BB4, a pn junction is formed between the electron emitting layer BB8 and the contact layer BB10 located under each of the first electrodes BB122*a*, BB122*b*, BB122*c*. As a result, photoelectrons by the near-field light outputted from the first electrode BB122*a* are outputted through the through hole BB18 of the first electrode BB122*a*; photoelectrons by the near-field light outputted from the first electrode BB122*b* are outputted through the through hole BB18 of the first electrode BB122*b*; photoelectrons by the near-field light outputted from the first electrode BB122*c* are outputted through the through hole BB18 of the first electrode BB122*c*. Therefore, it is feasible to detect light beams of a plurality of wavelengths included in the incident light.

When the bias voltage is applied between only the first electrode BB122*a* and the second electrode BB4, photoelectrons are outputted only through the through hole BB18 of the first electrode BB122*a*. This allows us to detect only the light of the wavelength that induced the plasmon resonance in the first electrode BB122*a*. Similarly, when the bias voltage is applied between only the first electrode BB122*b* and the second electrode BB4, we can detect only the light of the wavelength that induced the plasmon resonance in the first electrode BB122*b*; when the bias voltage is applied between only the first electrode BB122*c* and the second electrode BB4, we can detect only the light of the wavelength that induced the plasmon resonance in the first electrode BB122*c*. By applying the bias voltage between any one of the first electrodes BB122*a*, BB122*b*, BB122*c* and the second electrode BB4 as described above, the field assist type photocathode BB1 of the present invention, which is only one device, is able to individually detect light beams of multiple wavelengths included in the incident light (hv). FIGS. 23 and 24 showed the case with the three first electrodes having different patterns, but it is a matter of course that the number of first electrodes provided is not limited to it.

Figure 25:
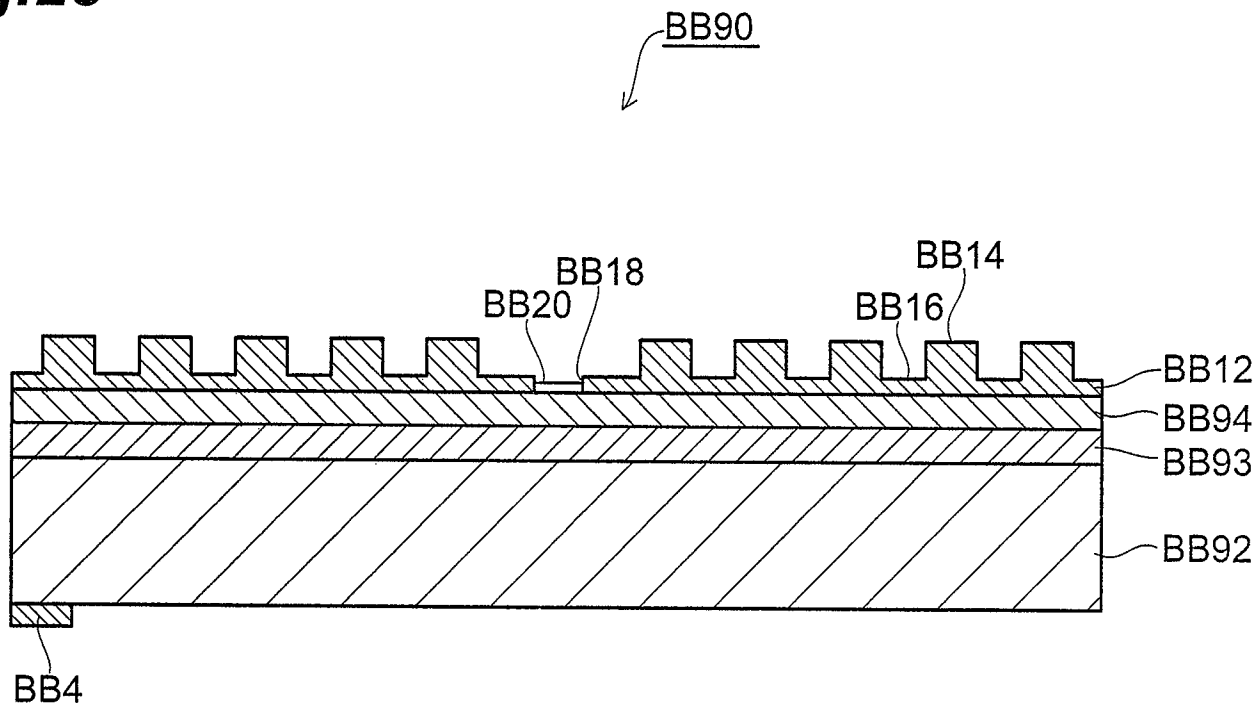
FIG. 25 is a drawing showing another modification example of the field assist type photocathode according to the second embodiment.

The field assist type photocathode BB1 of the second embodiment was the field assist type photocathode using the pn junction. However, without having to be limited to it, the field assist type photocathode of the present invention may be a field assist type photocathode using a Schottky junction, for example, as shown in FIG. 25. The field assist type photocathode BB90 shown in FIG. 25 has a support substrate BB92, a light absorbing layer BB93, an electron emitting layer BB94, and first and second electrodes BB12, BB4. The support substrate BB9 is made of a p-type InP semiconductor, the light absorbing layer BB93 of a p-type InGaAs semiconductor, and the electron emitting layer BB94 of a p-type InP semiconductor. A portion of the electron emitting layer BB94 exposed through the through hole BB18 of the first electrode BB12 is covered by an active layer BB20 which is formed as a very thin and uniform layer. The field assist type photocathode BB90 is different from the field assist type photocathode BB1 in that the contact layer BB10 is not formed on the electron emitting layer BB94 and the first electrode BB12 is directly laid on the electron emitting layer BB94 to make a Schottky junction.

Subsequently, steps of manufacturing the field assist type photocathode BB90 will be explained. The first step is to prepare the support substrate BB92 made of a p-type InP semiconductor. The light absorbing layer BB93 of a p-type InGaAs semiconductor and the electron emitting layer BB94 of a p-type InP semiconductor are then formed and laid in this order on the prepared support substrate BB92. These layers can be formed, for example, by metal-organic vapor phase epitaxy (MOVPE), chloride vapor phase epitaxy (chloride VPE), hydride vapor phase epitaxy (hydride VPE), molecular beam epitaxy (MBE), liquid phase epitaxy (LPE), and so on.

The next step is to form the first electrode BB12 on the electron emitting layer BB94 with a photoresist, as in the case of the manufacture of the field assist type photocathode BB1. More specifically, this step is to apply the photoresist onto the electron emitting layer BB94 and thereafter effect such patterning of the photoresist that openings are made in the regions where the projections BB14 are to be formed (cf. FIG. 16 (*b*)). The subsequent step is to effect evaporation to deposit an electroconductive film containing Al, Ag, Au, or the like on the electron emitting layer BB94 masked by the photoresist (cf. FIG. 16 (*c*)). The patterning of the photoresist BB22 may be implemented by photolithography with ultraviolet light or the like, or by electron beam lithography with an electron beam. The next step is to effect lift-off removal of portions of the electroconductive film deposited on the photoresist, together with the photoresist (cf. FIG. 16 (*d*)).

After the lift-off removal, an electroconductive film is again deposited by evaporation (cf. FIG. 17 (*a*)). After the deposition of the electroconductive film, a portion thereof is irradiated with a focused ion beam (FIB) to form the through hole BB18 (cf. FIG. 17 (*b*)). The next step is to form the active layer BB20 of such an alkali metal as Cs, on the portion of the electron emitting layer BB94 exposed through the through hole BB18 (cf. FIG. 17 (*c*)). The second electrode BB4 of AuGe/Ni or the like is formed on the first principal surface of the support substrate BB92. The field assist type photocathode BB90 shown in FIG. 25 is completed through the above steps.

Since the electron emitting layer BB94 and the first electrode BB12 make the Schottky junction in the field assist type photocathode BB90, application of the bias voltage between the first electrode BB12 and the second electrode BB4 causes the photoelectrons generated in the light absorbing layer BB93 to be transported into the electron emitting layer BB94 by virtue of action of the electric field established between the first electrode BB12 and the second electrode BB4, and to be emitted through the through hole BB18 with the active layer BB20 to the outside. The photoelectrons generated in the light absorbing layer BB93 are those by the near-field light outputted from the first electrode BB12, as in the case of the field assist type photocathode BB1. Thermal electrons are also generated in the light absorbing layer BB93, but the amount of thermal electrons emitted through the through hole BB18 is very small, for the same reason as in the field assist type photocathode BB1. Therefore, the same effect as with the aforementioned field assist type photocathode BB1 can be achieved. The material of the support substrate BB92 is not limited to the p-type InP semiconductor, but may be any one of glass, oxide materials, etc. as long as it can maintain the mechanical strength of the field assist type photocathode BB90. The material of the light absorbing layer BB93 is not limited to the p-type InGaAs semiconductor, but may be any one selected, for example, from compound semiconductors, such as GaAs, GaAsP, GaN, InGaN, AlGaN, InGaAsP, GaSb, and InGaSb, and mixed crystals thereof.

The field assist type photocathode BB90 is not applicable only to the so-called transmission type photocathode which emits the photoelectrons from the side opposite to the entrance side of the incident light, but is also applicable to the so-called reflection type photocathode which emits the photoelectrons from the same side as the entrance side of the incident light.

(Field Assist Type Photocathode Array)

A field assist type photocathode array will be described below. The field assist type photocathode array has a plurality of field assist type photocathodes BB1 as describe above. The plurality of field assist type photocathodes BB1 are one-dimensionally or two-dimensionally arrayed. The field assist type photocathode array is arranged to be able to independently apply the bias voltage to each field assist type photocathode BB1. Therefore, it becomes feasible to apply the bias voltage between the first and second electrodes BB12, BB4 in all the field assist type photocathodes BB1, or to apply the bias voltage between the first and second electrodes BB12, BB4 in only some of the field assist type photocathodes BB1. The field assist type photocathodes BB1 emit photoelectrons according to the application of the bias voltage; therefore, by permitting the application of the bias voltage to be performed individually for each field assist type photocathode BB1, it becomes feasible to appropriately vary the number of field assist type photocathodes BB1 to emit photoelectrons. As a result, it becomes feasible to vary the detection sensitivity for the light of the wavelength $\lambda_x$. If the one-dimensional or two-dimensional array of field assist type photocathodes is additionally provided with a means for successively applying the bias voltage, the array can have a position detection function. The field assist type photocathodes in the array may also be those using the Schottky junction, like the field assist type photocathode BB90 shown in FIG. 25.

(Image Intensifier)

Figure 26:
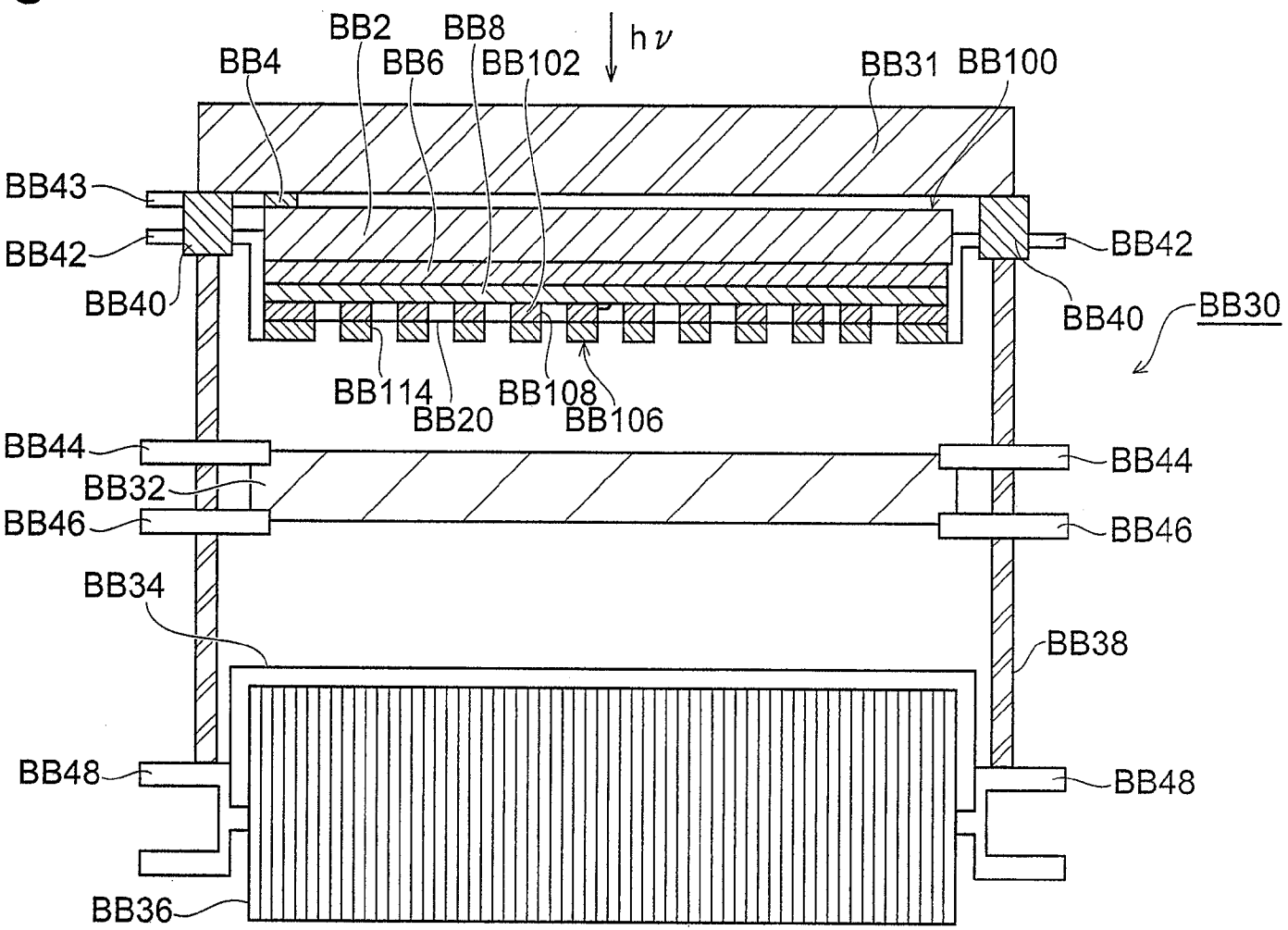
FIG. 26 is a sectional schematic view of an image intensifier according to the second embodiment of the present invention.

An image intensifier will be described below. FIG. 26 is a sectional schematic view of an image intensifier BB30.

The image intensifier BB30 has a glass face plate BB31, a field assist type photocathode BB100, a micro channel plate (MCP) BB32, a phosphor BB34, a glass fiber plate BB36, and a vacuum container BB38.

The field assist type photocathode BB100 has a support substrate BB2, a light absorbing layer BB6 laid on the support substrate BB2, an electron emitting layer BB8 laid on the light absorbing layer BB6, a contact layer BB102 laid on the electron emitting layer BB8, a first electrode BB106 laid on the contact layer BB102, and a second electrode BB4. The first electrode BB106 is formed by two-dimensionally arranging through holes BB114 at even intervals (predetermined intervals) like the first electrode BB12 shown in FIG. 20 (*c*). The diameter of the through holes BB114 is set shorter than the wavelength of the light incident to the first electrode BB12. The interval of the through holes BB114 is so set that the first electrode BB106 induces the surface plasmon resonance with the light of the wavelength $\lambda_x$ and outputs the near-field light of the wavelength $\lambda_y$. Though holes BB108 in communication with the through holes BB114 are two-dimensionally arrayed at even intervals (predetermined intervals) in the contact layer BB102. An active layer BB20, which is formed as a very thin and uniform layer, covers each of portions of the light absorbing layer BB6 exposed through the through holes BB108, BB114.

The glass face plate BB31 is supported at one end of the vacuum container BB38, and the glass face plate BB31 and the vacuum container BB38 are sealed with a seal portion BB40 of In or the like. The interior of the sealed vacuum container BB38 is vacuum. Inside the vacuum container BB38, the field assist type photocathode BB100, micro channel plate BB32, phosphor BB34, and glass fiber plate BB36 are disposed in order from the glass face plate BB31 side. The field assist type photocathode BB100 is mounted at one end inside the vacuum container BB38 so that the second electrode BB4 is located on the glass face plate BB31 side and that the first electrode BB106 is located on the micro channel plate BB32 side. An electrode BB42 is connected to the first electrode BB106 and an electrode BB43 is connected to the second electrode BB4. The micro channel plate BB32 and phosphor BB34 are provided with a plurality of electrodes BB44, BB46, BB48 for providing desired potentials.

A voltage is applied between the first electrode BB106 and the second electrode BB4 of the field assist type photocathode BB100 through the electrodes BB42, BB43. A voltage is applied between the field assist type photocathode BB100 and the micro channel plate BB32 through the electrodes BB42, BB44. A voltage for multiplication is applied between the upper side (hereinafter referred to as "input side") of the micro channel plate BB32 and the lower side (hereinafter referred to as "output side") of the micro channel plate BB32 through the electrodes BB44, BB46 connected to the micro channel plate BB32. A voltage of about several kV is applied between the micro channel plate BB32 and the phosphor BB34 through the electrode BB46 connected to the micro channel plate BB32 and the electrode BB48 connected to the phosphor BB34.

The following will describe the operation of the image intensifier BB30 having the configuration as described above. When light (hv) is incident to the glass face plate BB31 serving as an entrance window of the image intensifier BB30, the incident light (hv) travels through the glass face plate BB31 and through the support substrate BB2, the light absorbing layer BB6, the electron emitting layer BB8, and the contact layer BB10 of the field assist type photocathode BB100 to reach the first electrode BB106 of the field assist type photocathode BB100. When the incident light (hv) reaches the first electrode BB106, the surface plasmon resonance takes place in the first electrode BB106 with the light of the wavelength $\lambda_x$ included in the incident light (hv). This results in outputting the strong near-field light from the through holes BB114 of the first electrode BB106. The wavelength of the output near-field light is $\lambda_y$, which is the wavelength that can be absorbed in the light absorbing layer BB6.

The near-field light is received by the light absorbing layer BB6. The region around the through holes BB108, BB114 in the light absorbing layer BB6 receives the near-field light to generate photoelectrons in an amount according to the intensity of the near-field light (quantity of received light). Since the pn junction is formed between the electron emitting layer BB8 and the contact layer BB102, the photoelectrons generated in the light absorbing layer BB6 are transported into the electron emitting layer BB8 by virtue of action of an electric field established by the voltage applied between the first electrode BB106 and the second electrode BB4. At this time, among the photoelectrons generated in the light absorbing layer BB6, the photoelectrons generated in the region around the through holes BB108, BB114 are transported into the region around the through holes BB108, BB114, in the electron emitting layer BB8. The photoelectrons transported into the region around the through holes BB108, BB114 are emitted through the through holes BB108 of the contact layer BB102 whose work function is lowered by the active layer BB20, and through the through holes BB114 of the first electrode BB106 to the outside in vacuum.

The intensity of the near-field light is proportional to and greater than the intensity of the light of the wavelength $\lambda_x$ included in the incident light (hv). Therefore, a sufficient amount of photoelectrons are generated in the region around the through holes BB108, BB114 in the light absorbing layer BB6, so that a sufficient amount of photoelectrons are emitted through the through holes BB114 of the first electrode BB106. Thermal electrons, as well as the photoelectrons, are also generated in the region around the through holes BB108, BB114 in the light absorbing layer BB6. Since the diameter of the through holes BB114 is smaller than the wavelength of the incident light (hv), an amount of the thermal electrons generated in the region around the through holes BB108, BB114 is much smaller than the total amount of thermal electrons generated in the entire light absorbing layer BB6. Therefore, the amount of thermal electrons emitted through the through holes BB114 of the first electrode BB106 is extremely small.

The photoelectrons and thermal electrons emitted from the field assist type photocathode BB1 into vacuum, while being accelerated by the voltage applied between the field assist type photocathode BB100 and the micro channel plate BB32, impinge upon the micro channel plate BB32. The incident photoelectrons and thermal electrons are subjected to secondary electron multiplication by the micro channel plate BB32 and are again outputted into vacuum. Then they, while being accelerated by the voltage applied between the micro channel plate BB32 and the phosphor BB34, impinge upon the phosphor BB34 to cause emission of light. The light emitted from the phosphor BB34 is led through the glass fiber plate BB36 to the outside of the image intensifier BB30.

As described above, the image intensifier BB30 of the second embodiment has the field assist type photocathode BB100. In the field assist type photocathode BB100, the amount of emitted photoelectrons is increased while the amount of emitted thermal electrons is decreased; it is thus feasible to reduce the noise due to the thermal electrons. It is then feasible to provide the image intensifier BB30 with improved S/N ratios and with an excellent light detection sensitivity. Since the noise due to thermal electrons can be reduced by simply forming the through holes BB114 in the first electrode BB106, there is no need for provision of a separate cooing means or the like. Accordingly, miniaturization can be achieved for the field assist type photocathode BB100, so that the image intensifier BB30 can also be miniaturized.

The present invention is not limited to the above embodiment but may be modified in many ways. For example, the image intensifier BB30 of the second embodiment used the photocathode BB100 as a transmission type photocathode, which outputs the photoelectrons from the surface opposite to the entrance surface of the incident light (hv), but the photocathode BB100 may be used as a reflection type photocathode which outputs the photoelectrons from the entrance surface of the incident light (hv).

It is also possible to use the field assist type photocathode array consisting of a plurality of field assist type photocathodes BB100, instead of the field assist type photocathode BB100. Where the field assist type photocathode array is arranged to be able to individually apply the voltage to the first and second electrodes BB12, BB4 for each field assist type photocathode BB100, it becomes feasible to suitably change the number of operating field assist type photocathodes BB100. As a result, it becomes feasible to vary the detection sensitivity for the light of the wavelength $\lambda_x$.

(Line Focus Type Photomultiplier Tube)

Figure 27:
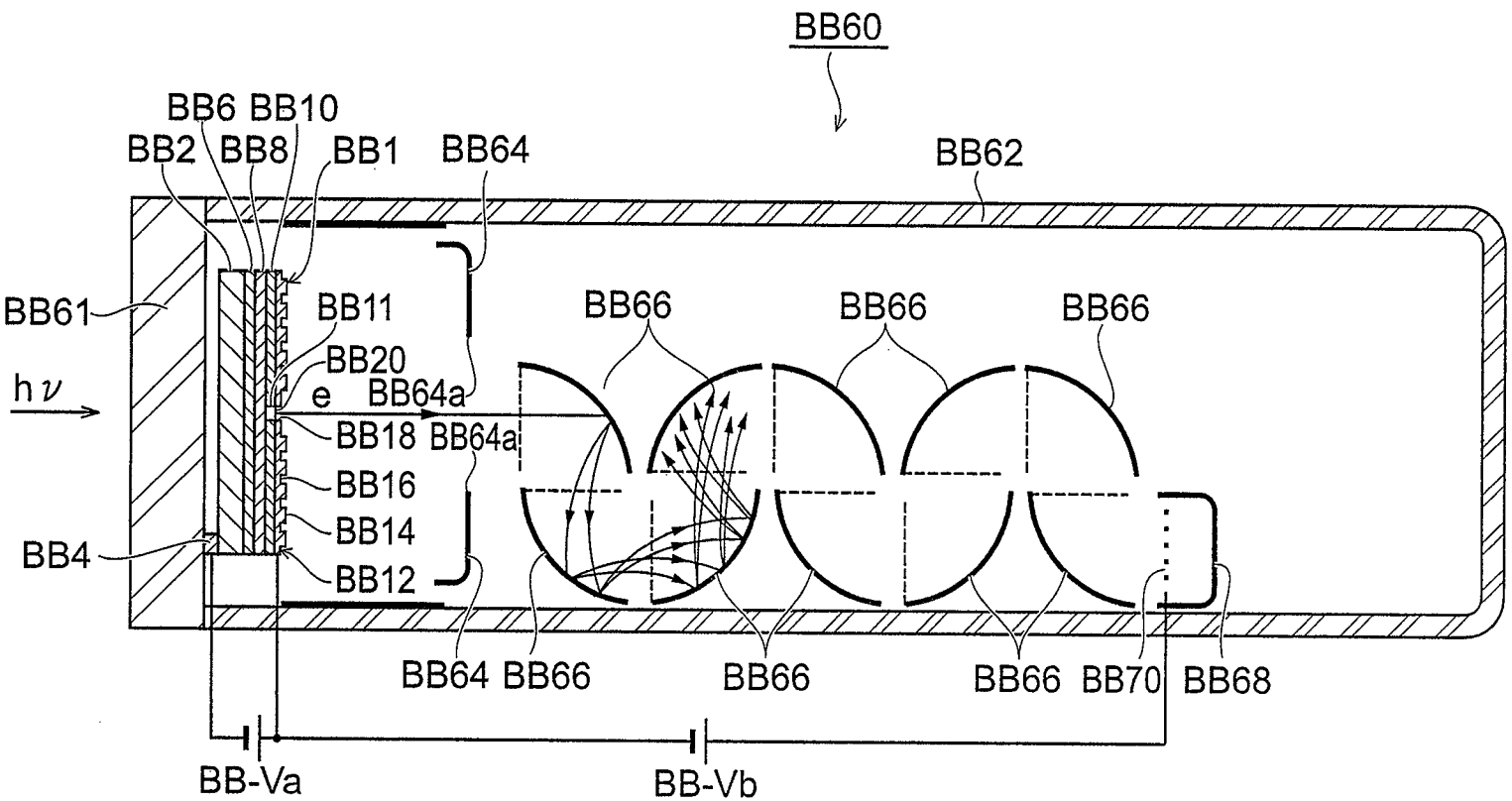
FIG. 27 is a sectional schematic view of a line focus type photomultiplier tube according to the second embodiment of the present invention.

A line focus type photomultiplier tube will be described below. FIG. 27 is a sectional schematic view of a photomultiplier tube BB60. The photomultiplier tube BB60 has a glass face plate BB61, the photocathode BB1 as shown in FIG. 13, a vacuum container BB62, a focusing electrode BB64, a plurality of dynodes BB66, a final dynode BB68, and an anode electrode BB70. The glass face plate BB61 is supported at one end of the vacuum container BB62, and the glass face plate BB61 and the vacuum container BB62 are sealed. The interior of the sealed vacuum container BB62 is vacuum. Inside the vacuum container BB62, the field assist type photocathode BB1, the focusing electrode BB64, the plurality of dynodes BB66, and the final dynode BB68 are disposed in order from the glass face plate BB61 side. The field assist type photocathode BB1 is mounted at one end of the vacuum container BB62 so that the second electrode BB4 is located on the glass face plate BB61 side and that the first electrode BB12 is located inside. The first electrode BB12 and the second electrode BB4 in the field assist type photocathode BB1 are connected to an external circuit so as to be able to apply a bias voltage BB-Va. The first electrode BB12 in the field assist type photocathode BB1 and the anode electrode BB70 are connected to an external circuit so as to be able to apply a bias voltage BB-Vb.

The focusing electrode BB64 is disposed inside the vacuum container BB62 so as to face the field assist type photocathode BB1 with a predetermined distance between them. An aperture BB64*a* is provided in the central part of the focusing electrode BB64. The plurality of dynodes BB66 are electron multiplying means for receiving photoelectrons emitted from the field assist type photocathode BB1, to generate secondary electrons, or for receiving secondary electrons from another dynode BB66 to generate a greater number of secondary electrons. The plurality of dynodes BB66 are of a curved shape and multiple stages of dynodes BB66 are repetitively arranged so that secondary electrons emitted from each dynode BB66 are received by another dynode BB66. The final dynode BB68 is a part that finally receives secondary electrons, after multiplied by the plurality of dynodes BB66. The anode electrode BB70 is connected to the final dynode BB68 and to an unrepresented stem pin.

The following will describe the operation of the photomultiplier tube BB60 having the configuration as described above. When light (hv) is incident to the glass face plate BB61 of the photomultiplier tube BB60, the incident light (hv) travels through the glass face plate BB61 and through the support substrate BB2, the light absorbing layer BB6, the electron emitting layer BB8, and the contact layer BB10 of the field assist type photocathode BB1 to reach the first electrode BB12 of the field assist type photocathode BB1. When the incident light (hv) impinges upon the first electrode BB12, the surface plasmon resonance takes place in the first electrode BB12 with the light of the wavelength $\lambda_x$ included in the incident light (hv). This results in outputting the strong near-field light from the through hole BB18 of the first electrode BB12. The wavelength of the output near-field light is $\lambda_y$, which is the wavelength that can be absorbed by the light absorbing layer BB6.

The near-field light is received by the light absorbing layer BB6. The region around the through holes BB11, BB18 in the light absorbing layer BB6 receives the near-field light and generates photoelectrons in an amount according to the intensity of the near-field light (quantity of received light). The photoelectrons generated in the light absorbing layer BB6 are transported into the electron emitting layer BB8 by virtue of action of the electric field established by the bias voltage applied between the first and second electrodes BB12, BB4. At this time, among the photoelectrons generated in the light absorbing layer BB6, the photoelectrons generated in the region around the through holes BB11, BB18, i.e., the photoelectrons by the near-field light are transported into the region around the through holes BB18, BB18, in the electron emitting layer BB8. The photoelectrons transported into the region around the through holes BB11, BB18 are emitted through the through hole BB11 of the contact layer BB10 whose work function is lowered by the active layer BB20, and through the through hole BB18 of the first electrode BB12 to the outside in vacuum.

The intensity of the near-field light is proportional to and greater than the intensity of the light of the wavelength $\lambda_x$ included in the incident light (hv). Therefore, the region around the through holes BB11, BB18 in the light absorbing layer BB6 generates a sufficient amount of photoelectrons, so that a sufficient amount of photoelectrons are outputted through the through hole BB18 of the first electrode BB12. Thermal electrons, as well as the photoelectrons, are also generated in the region around the through holes BB11, BB18 in the light absorbing layer BB6. Since the through hole BB18 is very narrow, an amount of the thermal electrons generated in the region around the through holes BB11, BB18 is much smaller than the total amount of thermal electrons generated in the entire light absorbing layer BB6. Therefore, the amount of thermal electrons emitted through the through hole BB18 is extremely small.

The photoelectrons and thermal electrons emitted from the field assist type photocathode BB1 into vacuum are drawn out and focused by the focusing electrode BB64 and pass through the aperture BB64*a* of the focusing electrode BB64. The plurality of dynodes BB66, receiving the photoelectrons and thermal electrons having passed through the aperture BB64*a*, generate secondary electrons and multiply the generated secondary electrons. The multiplied secondary electrons are led to the final dynode BB68 and further multiplied by the final dynode BB68. Since the bias voltage BB-Vb is applied between the anode electrode BB70 and the cathode electrode BB72, the secondary electrons after multiplied by the final dynode BB68 are collected by the anode electrode BB70 and outputted through the unrepresented stem pin connected to the anode electrode BB70, to the outside of the photomultiplier tube BB60.

As described above, the image intensifier BB60 of the second embodiment has the field assist type photocathode BB1 of the above-described embodiment. In the field assist type photocathode BB1, the amount of emitted photoelectrons is increased while the amount of emitted thermal electrons is decreased. It is thus feasible to reduce the noise due to the thermal electrons. It is then feasible to provide the image intensifier BB60 with improved S/N ratios and with an excellent light detection sensitivity. Since the noise due to thermal electrons can be reduced by simply forming the through hole BB18, projections BB14, and recess BB16 in the first electrode BB12, there is no need for provision of a separate cooing means or the like. Accordingly, miniaturization can be achieved for the field assist type photocathode BB1, so that the image intensifier BB60 can also be miniaturized.

The present invention is not limited to the above embodiment but may be modified in many ways. For example, the image intensifier BB60 used the field assist type photocathode BB1 as a transmission type photocathode, which outputs the photoelectrons from the surface opposite to the entrance surface of the incident light (hv), but the photocathode BB1 may be used as a reflection type photocathode which outputs the photoelectrons from the entrance surface of the incident light (hv).

It is also possible to use the field assist type photocathode array consisting of a plurality of field assist type photocathodes BB1, instead of the field assist type photocathode BB1. Where the field assist type photocathode array is arranged to be able to individually apply the voltage to the first and second electrodes BB12, BB4 for each field assist type photocathode BB1, it becomes feasible to suitably change the number of operating field assist type photocathodes BB1. As a result, it becomes feasible to vary the detection sensitivity for the light of the wavelength $\lambda_x$.

It is also possible to use the field assist type photocathode BB1 as shown in FIGS. 23 and 24, instead of the field assist type photocathode BB1 as shown in FIG. 13. In this case, where the field assist type photocathode is arranged to be able to individually apply the voltage to each of the first electrodes BB122*a*, BB122*b*, and BB122*c*, it becomes feasible to apply the bias voltage between all of the first electrodes BB122*a*, BB122*b*, BB122*c* and the second electrode BB4, or to apply the bias voltage between only the first electrode BB122*a* and the second electrode BB4. For example, when the bias voltage is applied between only the first electrode BB122*a* and the second electrode BB4, photoelectrons are outputted only through the through hole BB18 of the first electrode BB122*a*. This allows us to detect only the light of the wavelength that induced the plasmon resonance in the first electrode BB122*a*. Similarly, when the bias voltage is applied between only the first electrode BB122*b* and the second electrode BB4, we can detect only the light of the wavelength that induced the plasmon resonance in the first electrode BB122*b*; when the bias voltage is applied between only the first electrode BB122*c* and the second electrode BB4, we can detect only the light of the wavelength that induced the plasmon resonance in the first electrode BB122*c*. As a result, the photomultiplier tube BB60, which is only one device, is able to individually detect light beams of multiple wavelengths included in the incident light (hv).

(Electron Bombardment Type Photomultiplier Tube)

Figure 28:
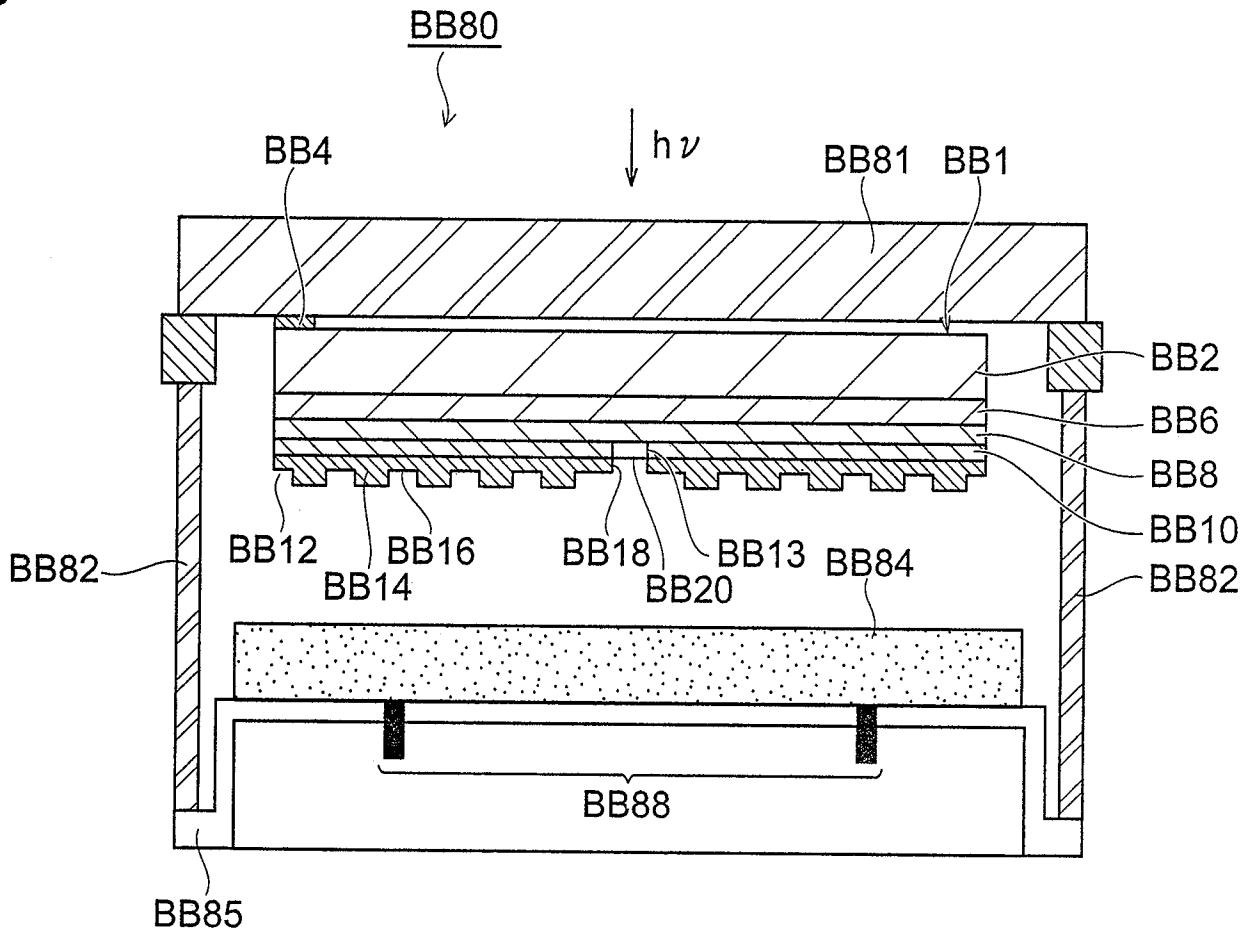
FIG. 28 is a sectional schematic view of an electron bombardment type photomultiplier tube according to the second embodiment of the present invention.

An electron bombardment type photomultiplier tube will be described below. FIG. 28 is a sectional schematic view of a photomultiplier tube BB80. The photomultiplier tube BB80 has a glass face plate BB81, the field assist type photocathode BB1 as shown in FIG. 13, a vacuum container BB82, and a photodiode BB84.

The glass face plate BB81 is supported at one end of the vacuum container BB82 and a bottom plate BB85 is supported at the other end of the vacuum container BB82. The glass face plate BB81 and the bottom plate BB85 airtightly seal the vacuum container BB82 to keep the interior of the vacuum container BB82 in vacuum. Inside the vacuum container BB82, the field assist type photocathode BB1 and the photodiode BB84 are disposed in order from the glass face plate BB81 side. The field assist type photocathode BB1 is mounted at one end inside the vacuum container BB82 so that the second electrode BB4 is located on the glass face plate BB81 side and that the first electrode BB12 is located on the photodiode BB84 side. The photodiode BB84 with multiplication action upon bombardment of photoelectrons is installed opposite to the field assist type photocathode BB1 on the upper surface of the bottom plate BB85. Stem pins BB88 are connected to the photodiode BB84 and one ends of the stem pins extend through the bottom plate BB85.

A voltage is applied through the stem pins BB88 to the photodiode BB84. A voltage is also applied between the stem pins and the first electrode BB12 in the field assist type photocathode BB1 and between the first electrode BB12 and the second electrode BB4 in the field assist type photocathode BB1.

The following will describe the operation of the photomultiplier tube BB80 having the configuration as described above. When light (hv) is incident to the glass face plate BB81 as an entrance window of the photomultiplier tube BB80, the incident light (hv) travels through the glass face plate BB81 to reach the field assist type photocathode BB1. The field assist type photocathode BB1 operates in the same manner as the field assist type photocathode BB1 in the line focus type photomultiplier tube BB60 does. Specifically, the first electrode BB12 of the field assist type photocathode BB1 induces the surface plasmon resonance with the light of the wavelength $\lambda_x$ included in the incident light (hv). Then the near-field light of the wavelength $\lambda_y$ is outputted from the through hole BB18. The region around the through holes BB11, BB18 in the light absorbing layer BB6 receives the near-field light to generate photoelectrons in an amount according to the intensity of the near-field light (quantity of received light). The photoelectrons generated in the region around the through holes BB11, BB18 in the light absorbing layer BB6 are outputted through the through hole BB11 of the contact layer BB10 whose work function is lowered by the active layer BB20, and through the through hole BB18 of the first electrode BB12 to the outside.

Since the intensity of the near-field light is proportional to and greater than the intensity of the light of the wavelength $\lambda_x$ included in the incident light (hv), a sufficient amount of photoelectrons are outputted through the through hole BB18 of the first electrode BB12. Thermal electrons generated in the region around the through holes BB11, BB18 in the light absorbing layer BB6 are also emitted through the through hole BB18 of the first electrode BB12, but an amount of emitted thermal electrons is far smaller than the total amount of thermal electrons generated in the entire light absorbing layer BB6.

The photoelectrons and thermal electrons outputted from the field assist type photocathode BB1 into vacuum, while being accelerated by the voltage applied between the field assist type photocathode BB1 and the photodiode BB84, impinge upon the photodiode BB84. The photodiode BB84, receiving the photoelectrons and thermal electrons, generates secondary electrons at a multiplication ratio of several thousand secondary electrons per incident photoelectron or thermal electron. The multiplied secondary electrons are outputted through the stem pins BB88 to the outside of the photomultiplier tube BB80.

As described above, the photomultiplier tube BB80 of the second embodiment has the field assist type photocathode BB1 of the above-described embodiment. In the field assist type photocathode BB1, the amount of emitted photoelectrons is increased while the amount of emitted thermal electrons is decreased. It is thus feasible to reduce the noise due to the thermal electrons. It is then feasible to provide the photomultiplier tube BB80 with improved S/N ratios and with an excellent light detection sensitivity. Since the noise due to thermal electrons can be reduced by simply forming the through hole BB18, projections BB14, and recess BB16 in the first electrode BB12, there is no need for provision of a separate cooing means or the like. Accordingly, miniaturization can be achieved for the field assist type photocathode BB1, so that the photomultiplier tube BB80 can also be miniaturized.

The present invention is not limited to the above embodiment but may be modified in many ways. For example, the photomultiplier tube BB80 used the field assist type photocathode BB1 as a transmission type photocathode, which outputs the photoelectrons from the surface opposite to the entrance surface of the incident light (hv), but the photocathode BB1 may be used as a reflection type photocathode which outputs the photoelectrons from the entrance surface of the incident light (hv).

It is also possible to use the field assist type photocathode array consisting of a plurality of field assist type photocathodes BB1, instead of the field assist type photocathode BB1. Where the field assist type photocathode array is arranged to be able to individually apply the voltage to the first and second electrodes BB12, BB4 for each field assist type photocathode BB1, it becomes feasible to suitably change the number of operating field assist type photocathodes BB1. As a result, it becomes feasible to vary the detection sensitivity for the light of the wavelength $\lambda_x$.

It is also possible to use the field assist type photocathode BB1 as shown in FIGS. 23 and 24, instead of the field assist type photocathode BB1 as shown in FIG. 13. In this case, the photomultiplier tube BB80, which is only one device, is also able to individually detect light beams of multiple wavelengths included in the incident light (hv) as the photomultiplier tube BB60 is.

In the photomultiplier tube BB80, the photoelectrons ($e^-$) were made incident to the photodiode BB84, but a charge coupled device (CCD) may also be used instead of the photodiode BB84.

What is claimed is:

1. A field assist type photocathode comprising:

a light absorbing layer for absorbing incident light to generate photoelectrons;

a first electrode formed on a side of a first principal surface of the light absorbing layer; and a second electrode formed on a side of a second principal surface of the light absorbing layer and, together with the first electrode, used for applying a voltage between the first principal surface and the second principal surface of the light absorbing layer;

wherein the first electrode has a through hole penetrating in a thickness direction and a pattern according to a predetermined rule for inducing surface plasmon resonance is formed in a surface of the first electrode; and wherein the light absorbing layer absorbs light outputted from the through hole of the first electrode, to generate the photoelectrons, and emits the photoelectrons generated, through the through hole of the first electrode to the outside.

2. The field assist type photocathode according to claim 1, further comprising:

a support substrate;

an electron emitting layer formed on the light absorbing layer and adapted to accelerate the photoelectrons generated in the light absorbing layer; and a contact layer formed on the electron emitting layer;

wherein the light absorbing layer is formed on the support substrate;

wherein the first electrode is electrically connected to the contact layer; and wherein the second electrode is electrically connected to the support substrate.

3. The field assist type photocathode according to claim 1, further comprising:

a support substrate; and an electron emitting layer formed on the light absorbing layer and adapted to accelerate the photoelectrons generated in the light absorbing layer;

wherein the light absorbing layer is formed on the support substrate;

wherein the first electrode makes a Schottky junction with the electron emitting layer; and wherein the second electrode is electrically connected to the support substrate.

4. The field assist type photocathode according to claim 1, wherein the first electrode has a plurality of projections and a recess located between the projections, the projections and the recess form said pattern, and the through hole is provided in the recess.

5. The field assist type photocathode according to claim 4, wherein the predetermined rule in the pattern is determined so that an amount of photoelectrons generated in said light absorbing layer is larger than an amount of photoelectrons generated in a light absorbing layer in a configuration in which a photocathode comprises a first electrode having a through hole and having neither of the projections and the recess formed in a surface thereof.

6. The field assist type photocathode according to claim 1, wherein the first electrode has a plurality of said through holes and the plurality of through holes form said pattern.

7. The field assist type photocathode according to claim 1, wherein a minimum width of the through hole is shorter than a wavelength of light incident to the first electrode.

8. The field assist type photocathode according to claim 1, wherein when viewed from a direction normal to the principal surfaces of the light absorbing layer, a portion inside the through hole of the first electrode is provided with an active layer for lowering a work function of said portion.

9. The field assist type photocathode according to claim 8, wherein the active layer is comprised of an alkali metal, an oxide of an alkali metal, or a fluoride of an alkali metal.

10. The field assist type photocathode according to claim 1, comprising a plurality of said first electrodes, wherein at least two out of the plurality of first electrodes have their respective periods of said patterns different from each other.

11. The field assist type photocathode according to claim 10, wherein the plurality of first electrodes are adapted so that each first electrode can individually apply a voltage.

12. A field assist type photocathode array comprising a plurality of field assist type photocathodes, wherein each photocathode comprising:

a light absorbing layer for absorbing incident light to generate photoelectrons;

a first electrode formed on a side of a first principal surface of the light absorbing layer; and a second electrode formed on a side of a second principal surface of the light absorbing layer and, together with the first electrode, used for applying a voltage between the first principal surface and the second principal surface of the light absorbing layer;

wherein the first electrode has a through hole penetrating in a thickness direction and a pattern according to a predetermined rule for inducing surface plasmon resonance is formed in a surface of the first electrode; and wherein the light absorbing layer absorbs light outputted from the through hole of the first electrode, to generate the photoelectrons, and emits the photoelectrons generated, through the through hole of the first electrode to the outside;

wherein the first and second electrodes of the field assist type photocathodes are adapted so as to be able to apply a voltage to each field assist type photocathode.

13. A field assist type electron tube comprising a field assist type photocathode, wherein said field assist type photocathode comprising:

a light absorbing layer for absorbing incident light to generate photoelectrons;

a first electrode formed on a side of a first principal surface of the light absorbing layer; and a second electrode formed on aside of a second principal surface of the light absorbing layer and, together with the first electrode, used for applying a voltage between the first principal surface and the second principal surface of the light absorbing layer;

wherein the first electrode has a through hole penetrating in a thickness direction and a pattern according to a predetermined rule for inducing surface plasmon resonance is formed in a surface of the first electrode; and wherein the light absorbing layer absorbs light outputted from the through hole of the first electrode, to generate the photoelectrons, and emits the photoelectrons generated, through the through hole of the first electrode to the outside.

14. A field assist type electron tube comprising a field assist type photocathode array comprising a plurality of field assist type photocathodes, wherein each photocathode comprising:

a light absorbing layer for absorbing incident light to generate photoelectrons;

a first electrode formed on a side of a first principal surface of the light absorbing layer; and a second electrode formed on a side of a second principal surface of the light absorbing layer and, together with the first electrode, used for applying a voltage between the first principal surface and the second principal surface of the light absorbing layer;

wherein the first electrode has a through hole penetrating in a thickness direction and a pattern according to a predetermined rule for inducing surface plasmon resonance is formed in a surface of the first electrode; and wherein the light absorbing layer absorbs light outputted from the through hole of the first electrode, to generate the photoelectrons, and emits the photoelectrons generated, through the through hole of the first electrode to the outside;

wherein the first and second electrodes of the field assist type photocathodes are adapted so as to be able to apply a voltage to each field assist type photocathode.

* * * * *